US010245517B2

(12) United States Patent
Cyr et al.

(10) Patent No.: US 10,245,517 B2
(45) Date of Patent: Apr. 2, 2019

(54) INTERACTIVE RIDE-ON TOY APPARATUS

(71) Applicant: Pacific Cycle, LLC, Madison, WI (US)

(72) Inventors: Terry J. Cyr, Madison, WI (US); Jesse C. Darley, Madison, WI (US); Matthew J. Poster, Madison, WI (US); Ryan M. Follmann, Madison, WI (US)

(73) Assignee: Pacific Cycle, LLC, Madison, WI (US)

( * ) Notice: Subject to any disclaimer, the term of this patent is extended or adjusted under 35 U.S.C. 154(b) by 0 days.

(21) Appl. No.: 15/936,726

(22) Filed: Mar. 27, 2018

(65) Prior Publication Data

US 2018/0272238 A1 Sep. 27, 2018

Related U.S. Application Data

(60) Provisional application No. 62/477,220, filed on Mar. 27, 2017, provisional application No. 62/477,629,
(Continued)

(51) Int. Cl.
*A63H 17/38* (2006.01)
*A63G 19/20* (2006.01)

(52) U.S. Cl.
CPC ..... *A63G 19/20* (2013.01); *A63H 17/38* (2013.01); *A63H 2200/00* (2013.01)

(58) Field of Classification Search
CPC ..... A63G 19/00; A63G 19/20; A63G 25/00; A63H 17/00; A63H 17/25; A63H 19/00; A63H 29/00; A63H 30/00
(Continued)

(56) References Cited

U.S. PATENT DOCUMENTS 1,308,425 A 7/1919 Johnson
2,224,411 A 12/1940 Smith
(Continued)

FOREIGN PATENT DOCUMENTS

CN 2119911 U 10/1992
EP 1051321 A1 8/1999
(Continued)

OTHER PUBLICATIONS

"Electric power plush walking horse toy"; Guangzhou Listar Technology Co., LTD; WWW.listartech.com; Retrieved Feb. 15, 2017.
(Continued)

*Primary Examiner* — Kien T Nguyen
(74) *Attorney, Agent, or Firm* — James A. Joyce; Godfrey & Kahn, S.C.

(57) ABSTRACT

An apparatus is provided that includes a torso and a plurality of legs, a first drive motor assembly secured to a first of the plurality of legs and to a first drive wheel, a second drive motor assembly secured to a second of the plurality of legs and to a second drive wheel, a motorized neck assembly coupling a head to the torso and providing a multi-directional rotational movement of the head, a rechargeable battery, a throttle switch to provide a throttle signal, a controller including one or more processors and memory devices, and an electrical steering position sensor configured to translate a mechanical steering input via manual rotation of the head into an electronic steering position signal that is communicated to the controller, wherein the controller is configured to selectively actuate at least one of the drive wheel motors based on the throttle signal and the steering position signal.

20 Claims, 34 Drawing Sheets

Related U.S. Application Data filed on Mar. 28, 2017, provisional application No. 62/552,502, filed on Aug. 31, 2017, provisional application No. 62/581,863, filed on Nov. 6, 2017.

(58) Field of Classification Search
USPC ..... 472/95–99; 446/465–468, 470; 280/1, 280/1.165, 1.201, 1.202, 1.23, 1.13–1.14, 280/1.16, 1.182
See application file for complete search history.

(56) References Cited

U.S. PATENT DOCUMENTS 2,253,096 A 8/1941 Roy
2,400,265 A 5/1946 Sieger
2,511,968 A 3/1949 Card
2,606,022 A 8/1952 Vander Veer et al.
2,646,990 A 7/1953 Fowler
2,782,032 A 2/1957 Plympton
2,800,323 A 7/1957 West et al.
2,832,426 A 4/1958 Seargeant
2,852,887 A 9/1958 Washington
2,960,345 A 11/1960 Chontos
3,073,409 A 1/1963 Daifotes
3,183,990 A 5/1965 Edwards
3,303,821 A 2/1967 Harris
3,348,518 A 10/1967 Forsyth
3,481,417 A 12/1969 Jarret
3,659,378 A 5/1972 Duncan
3,720,281 A 3/1973 Frownfelter
3,748,564 A 7/1973 Ohba
3,771,615 A 11/1973 Rieli
3,823,790 A 7/1974 Richison
3,867,993 A 2/1975 Kozaburo
4,057,752 A 11/1977 Artrip
4,063,607 A 12/1977 Patrick
4,081,725 A 3/1978 Schmidt
4,157,123 A 6/1979 Rodaway
4,157,826 A 6/1979 Sims
4,378,855 A 4/1983 Haub
4,415,049 A 11/1983 Wereb
4,497,500 A 2/1985 Mercurio
4,516,648 A 5/1985 Berger
4,516,951 A 5/1985 Saigo et al.
4,561,514 A 12/1985 Kazuo
4,562,893 A 1/1986 Cunard
4,626,750 A 12/1986 Post
4,648,473 A 3/1987 Bergner
4,657,098 A 4/1987 Wilcox
4,712,184 A 12/1987 Haugerud
4,772,829 A 9/1988 Pickering
4,926,952 A 5/1990 Farnam
4,988,300 A * 1/1991 Yamaguchi ..... A63B 69/04 280/1.201
4,999,556 A 3/1991 Masters
5,011,451 A 4/1991 Holtier
5,074,820 A 12/1991 Nakayama
5,135,427 A 8/1992 Suto
5,141,464 A 8/1992 Stern et al.
5,158,492 A 10/1992 Rudell
5,180,023 A 1/1993 Reimers
5,261,025 A 11/1993 Post
5,275,248 A 1/1994 Finch
5,334,075 A 8/1994 Kakizaki
5,429,543 A 7/1995 Tibor
5,487,437 A 1/1996 Avitan
5,568,926 A 10/1996 Kaptein
5,592,997 A 1/1997 Ball
5,644,114 A 7/1997 Neaves
5,697,465 A 12/1997 Kruse
5,697,621 A 12/1997 Nazarian
5,762,155 A 6/1998 Scheulderman
5,805,140 A 9/1998 Rosenberg et al.
5,842,532 A 12/1998 Fox et al.
5,859,509 A 1/1999 Bienz
5,885,159 A 3/1999 DeAngelis
5,921,843 A 7/1999 Skrivan et al.
5,924,506 A 7/1999 Perego
5,989,096 A 11/1999 Barton et al.
5,994,853 A 11/1999 Ribbe
6,039,327 A 3/2000 Spector
6,039,626 A 3/2000 Gerold
6,089,942 A 7/2000 Chan
6,089,948 A 7/2000 LaBarbara, Jr.
6,095,268 A 8/2000 Jones, Jr.
6,105,982 A 8/2000 Howell
6,139,061 A 10/2000 Lewis
6,149,490 A 11/2000 Hampton
6,202,773 B1 3/2001 Joseph
6,250,987 B1 6/2001 Choi
6,257,948 B1 7/2001 Silva
6,283,237 B1 9/2001 Muller
6,287,167 B1 9/2001 Kondo
6,405,817 B1 6/2002 Huntsberger et al.
6,412,787 B1 7/2002 Pardi et al.
6,435,936 B1 8/2002 Rehkemper
6,470,982 B2 10/2002 Sitarski et al.
6,471,565 B2 10/2002 Simeray
6,497,607 B1 12/2002 Hampton
6,499,747 B2 12/2002 Fagan
6,514,117 B1 2/2003 Hampton
6,522,244 B2 2/2003 Huntsberger
6,524,156 B1 2/2003 Horchler
6,537,128 B1 3/2003 Hampton
6,544,098 B1 4/2003 Hampton
6,554,087 B2 4/2003 Huntsberger
6,554,679 B1 4/2003 Shackelford
6,565,407 B1 5/2003 Woolington
6,589,098 B2 7/2003 Lee
6,620,024 B2 9/2003 Choi
6,736,694 B2 5/2004 Hornsby
6,771,034 B2 8/2004 Reile
6,773,327 B1 8/2004 Felice
6,780,076 B2 8/2004 Horchler
D500,097 S 12/2004 Passmore
6,843,703 B1 1/2005 Iaconis
7,020,310 B2 3/2006 Turney
7,025,657 B2 4/2006 Nishimoto
7,047,108 B1 5/2006 Rainier et al.
7,062,073 B1 6/2006 Turney
7,066,782 B1 6/2006 Maddocks et al.
7,118,443 B2 10/2006 Marine
7,203,642 B2 4/2007 Ishii et al.
7,207,588 B2 4/2007 Bergum
7,207,859 B1 4/2007 Iaconis
7,207,860 B2 4/2007 Hornsby
7,222,684 B2 5/2007 Norman
7,300,328 B2 11/2007 Klick, Jr.
7,364,489 B1 4/2008 Iaconis
7,416,468 B1 8/2008 Felice
7,431,629 B1 10/2008 Maddocks
7,507,139 B1 3/2009 Maddocks et al.
7,568,538 B2 8/2009 Drosendahl
7,621,552 B2 11/2009 Bergum
7,637,794 B2 12/2009 Barri
7,695,341 B1 4/2010 Maddocks
7,731,560 B2 6/2010 Kratz
7,749,043 B1 7/2010 Rehkemper
7,794,303 B2 9/2010 Cassidy
7,837,531 B2 11/2010 Friedland
7,901,265 B1 3/2011 Cameron
7,938,218 B2 5/2011 Howell
7,942,720 B1 5/2011 Galoustian
7,950,978 B2 5/2011 Norman
7,988,168 B2 8/2011 Miroewski
7,988,522 B2 8/2011 Chen
8,092,271 B2 1/2012 Garbos
8,175,747 B2 5/2012 Lee
8,366,135 B2 2/2013 Asbach et al.
8,371,897 B1 2/2013 Wong
8,376,803 B2 2/2013 Oonaka
8,414,350 B2 4/2013 Rehkemper
8,483,873 B2 7/2013 Wong
8,529,310 B2 9/2013 Powers

(56) References Cited

U.S. PATENT DOCUMENTS

| | | | | |
|---|---|---|---|---|
| 8,662,955 | B1 | 3/2014 | Fai | |
| 8,827,279 | B1 | 9/2014 | Clark | |
| 8,909,370 | B2 | 12/2014 | Stiehl | |
| 8,915,791 | B2 * | 12/2014 | Gibson | A63G 13/06 280/1.23 |
| 9,079,110 | B2 | 7/2015 | Byrne | |
| 9,079,113 | B2 | 7/2015 | Wong | |
| 9,211,476 | B2 | 12/2015 | Curry, Sr. | |
| 9,266,577 | B2 | 2/2016 | Todokoro | |
| 9,550,131 | B2 | 1/2017 | Loetz | |
| 9,636,598 | B2 | 5/2017 | Cai | |
| 9,665,179 | B2 | 5/2017 | Degtyarev | |
| 2002/0089297 | A1 | 7/2002 | Filo | |
| 2005/0233676 | A1 | 10/2005 | Bohart | |
| 2005/0287924 | A1 | 12/2005 | Haney | |
| 2012/0315821 | A1 | 12/2012 | Hayakawa | |
| 2013/0206488 | A1 | 8/2013 | Horinouchi | |
| 2013/0277128 | A1 | 10/2013 | Gillett | |
| 2014/0273728 | A1 | 9/2014 | Rehkemper | |
| 2016/0009335 | A1 | 1/2016 | Biderman et al. | |

FOREIGN PATENT DOCUMENTS

| | | | |
|---|---|---|---|
| GB | 630496 | A | 10/1949 |
| GB | 2450887 | | 1/2009 |
| WO | WO 9534267 | A1 | 12/1995 |

OTHER PUBLICATIONS

"Snuggles My Dream Puppy"; Moose Toys; www.moosetoys.com/products/little-live-pets-snuggles-my-dream-puppy; Retreived Jul. 16, 2018.

"Adult pedal cars walking hourse toy motorized animals for rent"; Guangzhou Hansel Electronic Technology Co., LTD; www.hanseltech.com; Retrieved Feb. 15, 2017.

"Zoomer—Show Pony"; Spin Master, Ltd.; www.shop.spinmaster.com/zoomer-show-pony/product/p21262 Acknowledged Jan. 1, 2017 Retreived Jul. 16, 2018.

International Search Report for PCT/US18/24595; dated Jun. 26, 2018.

* cited by examiner

| Sequence | Audio Content | Motor Description | Eyes |
|---|---|---|---|
| SEQ_RideOnStart | Big Neigh | Head bobs up and down. | Blink after head bob. |
| SEQ_MovementPrompt | Impatient Neigh | Head bobs up and down. | Blink after head bob. |
| SEQ_RideOnStop | Snort | Head bobs up and down. | Blink with snort. |
| SEQ_RideOnSleep | Sigh/Bored Sounds/Yawn/Snore | Head lifts slowly and comes back down during yawn. | Eyes slowly close. (stay closed) |
| SEQ_RidingILoveYou | I love you | Head bobs up and down. | 3 quick blinks. |
| SEQ_RidingNosePetting1 | Gentle Sigh | No motor movement. | Close eyes during sigh, then open again. |
| SEQ_RidingNosePetting2 | Gentle Sigh 2 | No motor movement. | Close eyes during sigh, then open again. |
| SEQ_RidingNosePetting3 | Coo 2 | No motor movement. | Close eyes during coo, then open again. |
| SEQ_RidingLeftPetting1 | Neigh | Head bobs up then down once. | (stay open) |
| SEQ_RidingLeftPetting2 | Tickled giggle 1 | Head bobs up then down once. | Blink |
| SEQ_RidingLeftPetting3 | Happy neigh 1 | Head bobs up then down once. | Blink |
| SEQ_RidingRightPetting1 | Blow | Head bobs up then down once. | (stay open) |
| SEQ_RidingRightPetting2 | Tickled giggle 2 | Head bobs up then down once. | Blink |
| SEQ_RidingRightPetting3 | Happy neigh 2 | Head bobs up then down once. | Blink |
| SEQ_RidingLongLeftPetting1 | Gentle sighing/*looping | Head bobs up then down once. | Blink every 4s of loop. |

FIG. 24A

| | | | |
|---|---|---|---|
| SEQ_RidingLongRightPetting1 | Coo | Head bobs up then down once. | Blink every 4s of loop. |
| SEQ_RidingManeBrushing1 | 1st gentle sound | Head bobs up and down. | Half close eyes, then open again. |
| SEQ_RidingManeBrushing2 | 2nd gentle sound | Head bobs up and down. | Half close eyes, then open again. |
| SEQ_RidingManeBrushing3 | 3rd gentle sound | Head bobs up and down. | Half close eyes, then open again. |
| SEQ_Gallop | *SFX_Galloping | Head bobs up and down with the clops. | Occasional blinking. |
| SEQ_GallopFast | *SFX_GallopingFast | Head bobs up and down with the clops. | Occasional blinking. |
| SEQ_RideOnSong | *MUS_RideOn | Head bobs with the music. (speed should be same as Gallop) | Occasional blinking. |
| SEQ_WilliamTell | *MUS_WilliamTell | Head bobs with the music. (check ending) | Occasional blinking. |
| SEQ_BackingUp | *SFX_BackingUpClipClop | Head bobs up and down with the clops. | Occasional blinking.<br>Remove 2nd eye blinks. |
| SEQ_RidingNeigh1 | Big riding neigh 1 | Head bobs up and down. | (stay open) |
| SEQ_RidingNeigh2 | Big riding neigh 1 | Head bobs up and down. | (stay open) |

FIG. 24B

| Sequence | Audio Content | Motor Description | Eyes |
|---|---|---|---|
| SEQ_WakeUp | Wake up sound. | Stretching routine; Wheels move forward than back. | Half open eyes, pause, then open the rest. |
| SEQ_Sniff | Sniff | Head bobs up and down; wheels move just a little bit forward. | Blink with sniff sound. |
| SEQ_Fart | *SFX_Fart | Move forward after sound ends. | (stay open) |
| SEQ_Sneeze | Sneeze | Head bobs up and down. Wiggle in place during sound, move backward after sound ends. | Close eyes during sneeze. |
| SEQ_DoNotWant1 | Uh-uh | Head shakes side to side. | Close eyes during shake, then open again. |
| SEQ_DoNotWant2 | Rejection sound 1/*doesn't want food | Head shakes side to side. | (stay open) |
| SEQ_DoNotWant3 | Rejection sound 2/*doesn't want food | Head shakes side to side. | (stay open) |
| SEQ_Annoyed | Annoyed sound | Head shakes side to side. Larger wiggle in place (copy from tickle giggle wiggle. | Close eyes during shake, then open again. |
| SEQ_Eating1 | *SFX_ChompingLoop | No motor movement. | Blink every 4s of loop. |
| SEQ_Eating2 | *SFX_ChompingLoop2 | No motor movement. | Blink every 4s of loop. |
| SEQ_Eating3 | *SFX_Licking | No motor movement. | Blink every 4s of loop. |
| SEQ_EatingOver1 | Happy sound | Front feet wiggle back and forth in place. | Blink at end of wiggle. |
| SEQ_EatingOver2 | Burp | Head bobs up and down. Move backward after sound ends. | (stay open) |
| SEQ_EatingOver3 | *SFX Fart | Head goes left and back to center -reaction to fart. Move forward after sound ends. | Blink with fart noise. |

FIG. 25A

| | | | |
|---|---|---|---|
| SEQ_EatingOver4 | Happy sound | Head bobs up and down. Wheels shimmy (different wiggle than EatingOver1). | (stay open) |
| SEQ_EatingTooMuch1 | Full Sound | Head shakes side to side, move backwards slightly. | Close eyes during shake, then open again. |
| SEQ_EatingTooMuch2 | Full Sound2 | Head shakes side to side, move backwards slightly. | Close eyes during shake, then open again. |
| SEQ_EatingTooMuch3 | Done sound/*doesn't want anymore food | Head shakes side to side, move backwards slightly. | (stay open) |
| SEQ_FeedingPrompt | Hungry Sound | Head bobs, wiggle feet with net forward movement. | Blink twice. |
| SEQ_BrushingPrompt | Questioning snort | Head shakes side to side. Wiggle back and forth in place. | Blink with head shake. |
| SEQ_TickledGiggle1 | Tickled giggle 1 | Front feet wiggle and head shake. | Blinking |
| SEQ_TickledGiggle2 | Tickled giggle 2 | Front feet wiggle and head bob. | Blinking |
| SEQ_TickledGiggle3 | Tickled giggle 3 | Front feet wiggle and head bobs and shakes side to side. | Blinking |
| SEQ_NosePetting1 | Gentle Sigh | Front feet wiggle back and forth in place. | Close eyes during sigh, then open again. |
| SEQ_NosePetting2 | Gentle Sigh 2 | Front feet wiggle back and forth in place. | Close eyes during sigh, then open again. |
| SEQ_NosePetting3 | Coo 2 | Front feet wiggle back and forth in place. | Close eyes during coo, then open again. |
| SEQ_LeftPetting1 | Gentle blow | Head goes left and back to center. Right foot pumps forward then back. | (stay open) |
| SEQ_LeftPetting2 | Gentle blow 2 | Head goes left and back to center. Right foot pumps forward then back. | (stay open) |
| SEQ_LeftPetting3 | Gentle Sigh 3 | Head goes left and back to center. Right foot pumps forward then back. | (stay open) |

FIG. 25B

| | | | |
|---|---|---|---|
| SEQ_RightPetting1 | Gentle Snort | Head goes right and back to center. Left foot pumps forward then back. | (stay open) |
| SEQ_RightPetting2 | Gentle Snort 2 | Head goes right and back to center. Left foot pumps forward then back. | (stay open) |
| SEQ_RightPetting3 | Gentle Sigh 4 | Head goes right and back to center. Left foot pumps forward then back. | (stay open) |
| SEQ_LongLeftPetting1 | Gentle sighing/*looping | Head goes left and stays there. Right foot forward pumps and stays out. | Blink every 4s of loop. |
| SEQ_LongRightPetting1 | Coo | Head goes right and stays there. Left foot forward pumps and stays out. | Blink every 4s of loop. |
| SEQ_ManeBrushing1 | 1st gentle sound | Head bobs up and down. Right hoof pumps. | Half close eyes, then open again. |
| SEQ_ManeBrushing2 | 2nd gentle sound | Head goes left and back to center. Left hoof pumps. | Half close eyes, then open again. |
| SEQ_ManeBrushing3 | 3rd gentle sound | Head goes right and back to center. Right hoof pumps. | Half close eyes, then open again. |
| SEQ_ILoveYou | I love you | Front feet wiggle back and forth in place. | Blink 3 times. |
| SEQ_RidingPrompt | Inviting Sound | Head bobs, right hoof pumps forward and back 3 times. | Blink at end of musical riff. |
| SEQ_RideOver1 | Victorious Neigh | Head bobs up and down. Forward pulses with the wheels. | Blink at end of neigh. |
| SEQ_RideOver2 | Sad sound/*sad the ride is over | Head shakes side to side. | Blink at end of sad sound. |
| SEQ_RideOver3 | Exhausted sigh/*after a long ride | Head goes up and holds, come down with sigh. | Half close eyes, then open again. |
| SEQ_Dance | *MUS_DanceSong | Unique dance routine that goes with music. | Some blinks with music. |
| SEQ_Dance2 | *MUS_DanceSong | Unique dance routine that goes with music. Start with pumping in a right circle, then pump in left circle | Some blinks with music. |
| SEQ_SIeep | Yawn/Snore | Head lifts slowly and comes back down during yawn. | Eyed slowly close (stay closed) |

FIG. 25C

INTERACTIVE RIDE-ON TOY APPARATUS

CROSS-REFERENCE TO RELATED APPLICATIONS

This application claims priority to U.S. Provisional Patent Appl. No. 62/477,220 filed on Mar. 27, 2017, U.S. Provisional Patent Appl. No. 62/477,629 filed on Mar. 28, 2017, U.S. Provisional Patent Appl. No. 62/552,502 filed on Aug. 31, 2017, and U.S. Provisional Patent Appl. No. 62/581,863 filed on Nov. 6, 2017, the disclosures of which are incorporated herein by reference in their entirety for all purposes.

FIELD OF THE INVENTION

The invention relates generally to the field of motorized toys. More particularly, a motorized interactive ride-on toy.

BACKGROUND

Motorized ride-on toys have been driven by children for many years, although the ability to control and interact with these toys has been notably limited, thereby diminishing a user's overall experience. Accordingly, a need exists for a ride-on toy that engages the user through improved interactive and control capabilities.

SUMMARY OF THE INVENTION

The terms used herein should not be interpreted as being limited to specific forms, shapes, or compositions. Rather, the parts can have a wide variety of shapes and forms and can be composed of a wide variety of materials. These and other features of the apparatus will become apparent from the detailed description, claims, and accompanying drawings.

In at least some embodiments, the apparatus is an interactive ride-on toy apparatus that includes: a torso; a plurality of legs secured to the torso; a first drive motor assembly secured to a first of the plurality of legs and to a first drive wheel; a second drive motor assembly secured to a second of the plurality of legs and to a second drive wheel; a motorized neck assembly coupling a head to the torso, wherein the neck assembly provides a multi-directional rotational movement of the head relative to the torso; a rechargeable battery; a throttle switch to provide a throttle signal; a controller including one or more processors and memory devices; and an electrical steering position sensor configured to translate a mechanical steering input via manual rotation of the head into an electronic steering position signal that is communicated to the controller, wherein the controller is configured to receive the throttle signal and the steering position signal, and selectively actuate at least one of the drive wheel motors based on the throttle signal and the steering position signal.

In at least some other embodiments, the apparatus is an interactive ride-on toy that includes: a torso having a first torso portion and a second torso portion; a first front leg and a second front leg, each extending down from the first torso portion; a first drive motor coupled to the first front leg and to a first drive wheel; a second drive motor coupled to the second front leg and to a second drive wheel, wherein the first and second drive wheels are rotatable propel the apparatus along a surface; a non-motorized wheel coupled to the second torso portion; a motorized neck assembly coupling a head to the first torso portion, wherein the neck assembly provides selective rotational movement of the head along both a first rotational head axis and a second rotational head axis; a rechargeable battery; a throttle switch to provide a throttle input signal; a controller for receiving the throttle input signal and selectively actuating the drive motor assemblies with power from the battery; an electrical steering position sensor for receiving a mechanical steering input upon manual rotation of the head, wherein the controller proportionally varies the applied power from the battery to the first drive motor assembly and the second drive motor assembly based on a steering position signal provided by the steering position sensor; a plurality of touch-based sensors situated in the head for providing a touch input signal; reins coupled to the head, wherein the reins include the throttle switch and a speed and direction selection switch; a speaker for emitting sounds selected by the controller; and a seat positioned on the torso.

In at least yet some embodiments, the apparatus is an interactive ride-on toy that includes: a torso having a first torso portion pivotably coupled to a second torso portion along a vertical pivot joint; a first front leg and a second front leg, each extending down from the first torso portion; a first drive motor assembly secured to the first front leg and to a first drive wheel; a second drive motor assembly secured to the second front leg and to a second drive wheel, wherein the first and second drive wheels are rotatable about a single rotational drive axis to propel the apparatus along a surface; a first rear leg and a second rear leg, each extending down from the second torso portion and including a wheel secured thereto; a motorized neck assembly coupling a head to the first torso portion, wherein the neck assembly provides selective rotational movement of the head along both a first rotational head axis and a second rotational head axis, wherein the second rotational head axis lies parallel to the rotational drive axis and perpendicular to the first rotational head axis; a rechargeable battery situated in at least one of the torso and the head; a throttle switch to provide a throttle input; a controller for receiving the throttle input and selectively actuating the drive motor assemblies using the rechargeable battery; an electrical steering position sensor for receiving a mechanical steering input via manual rotation of the head, and wherein the controller proportionally varies the applied power from the battery to the first drive motor assembly and the second drive motor assembly based on a received steering position sensor input; a plurality of touch-based sensors situated in the head for receiving touch signals from a user; wherein the head includes a mouth, eyelids, and ears, and wherein the eyelids and the ears are rotatably actuatable via a signal from the controller; reins pivotably coupled to the head, wherein the reins include the throttle switch and a speed and direction selection switch, and wherein the reins are coupled to the head via a reins pivot assembly that allows the reins to be rotated between a forward position and a back position relative to the head, and wherein the reins pivot assembly provides a reins position input signal to the controller indicating the position; a speaker for emitting sounds selected by the controller; a seat positioned on the torso; a first seat switch situated between the seat and the torso, wherein actuation of the first seat switch by a user provides a rider detected input signal; a motion sensor configured to detect the presence of another object situated in front of the first torso portion; and a mode selection switch for selecting between a first mode and a second mode, wherein the first mode directs the controller to actuate the drive wheel motor assemblies and neck assembly according to a predetermined sequence, and the second mode directs the controller to actuate the drive wheel motor assemblies only during actuation of the throttle switch.

BRIEF DESCRIPTION OF THE DRAWINGS

Embodiments of a toy apparatus are disclosed with reference to the accompanying drawings and are for illustrative purposes only. The toy apparatus is not limited in application to the details of construction or the arrangement of the components illustrated in the drawings. The toy apparatus is capable of other embodiments or of being practiced or carried out in other various ways. In the drawings:

FIGS. 24A-24B illustrate a first exemplary sequence table for the apparatus of FIG. 1; and FIGS. 25A-25C illustrate a second exemplary sequence table for the apparatus of FIG. 1.

DETAILED DESCRIPTION

Figure 1:
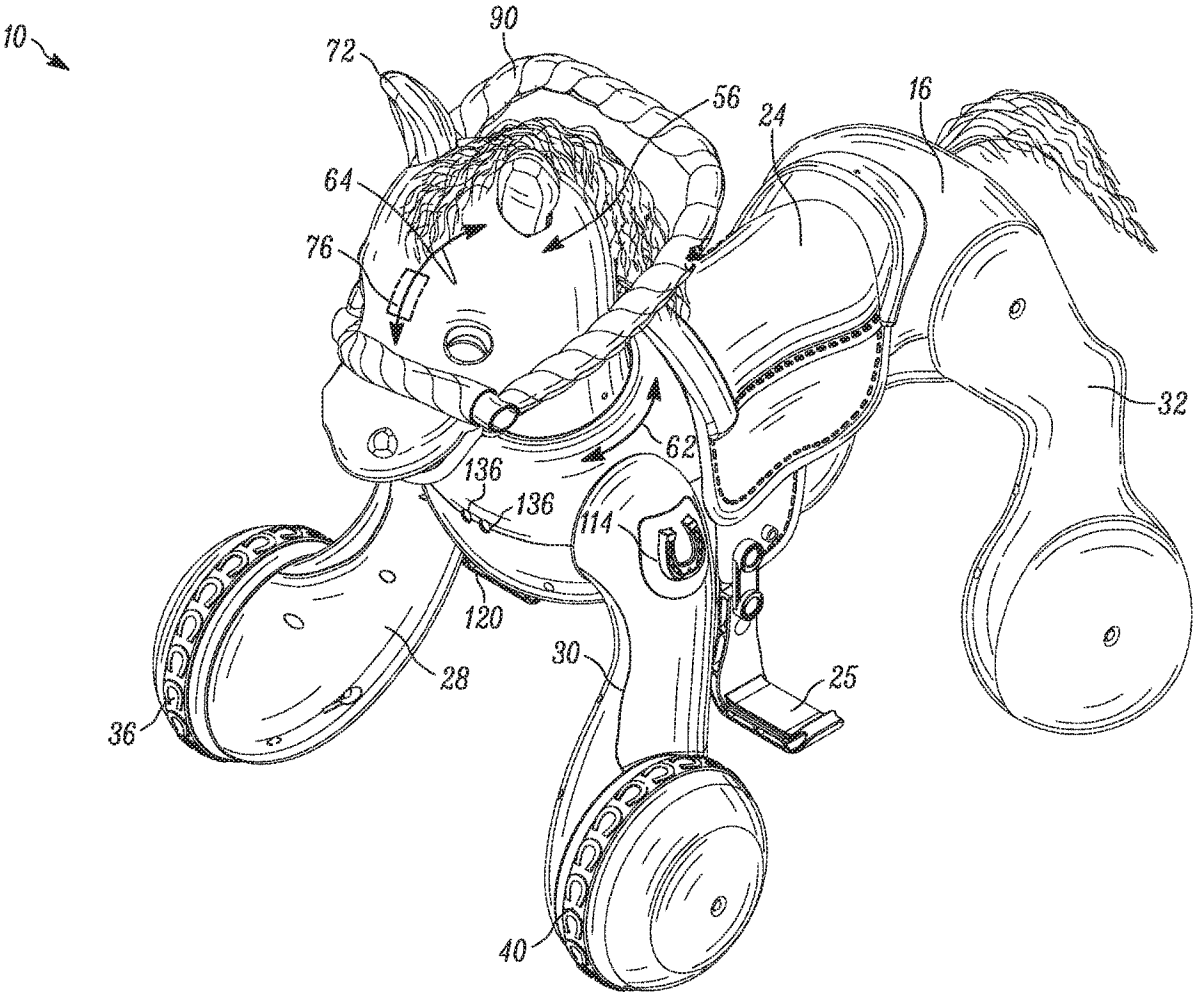
FIG. 1 is a front perspective view of an exemplary embodiment of a toy apparatus.
Figure 2:
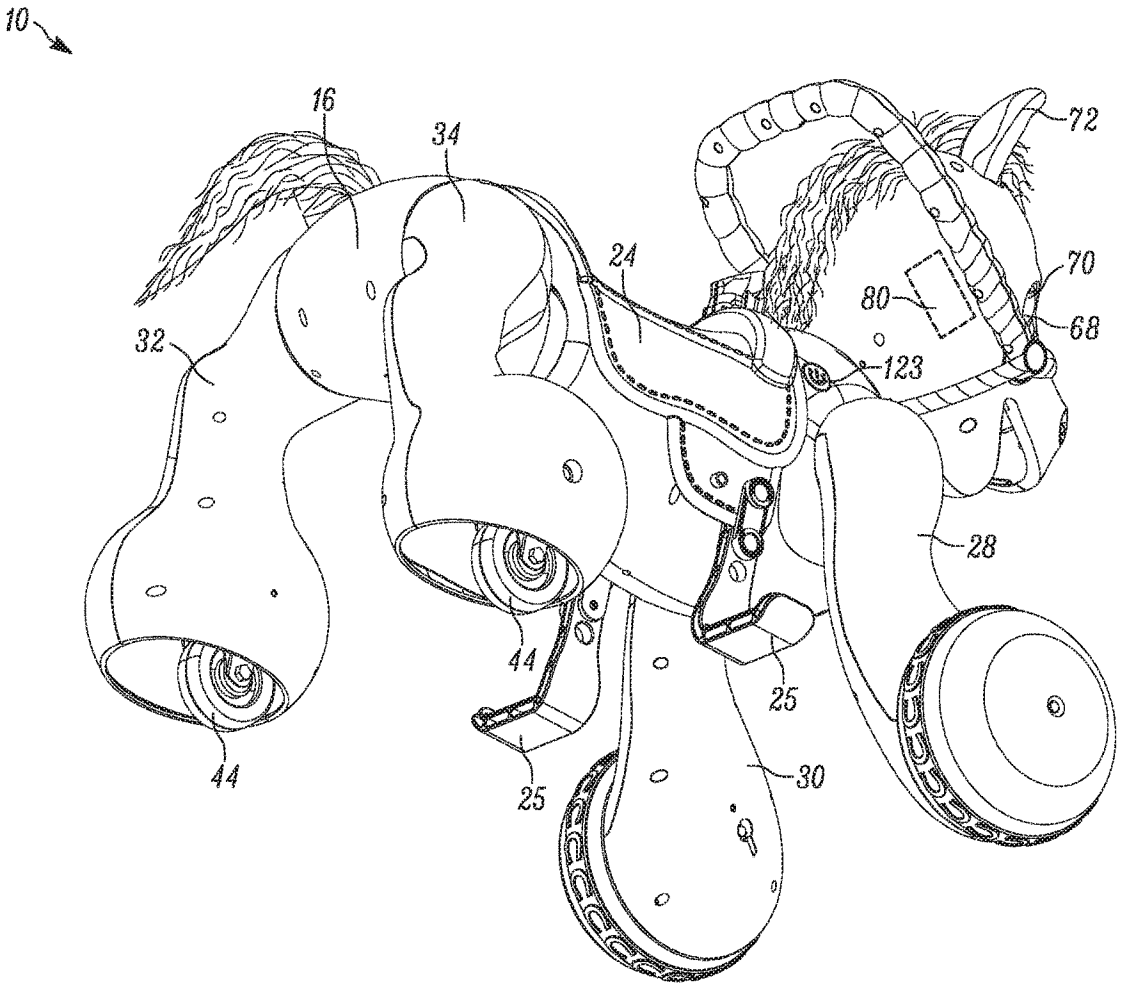
FIG. 2 is a bottom perspective view of the apparatus of FIG. 1.
Figure 3:
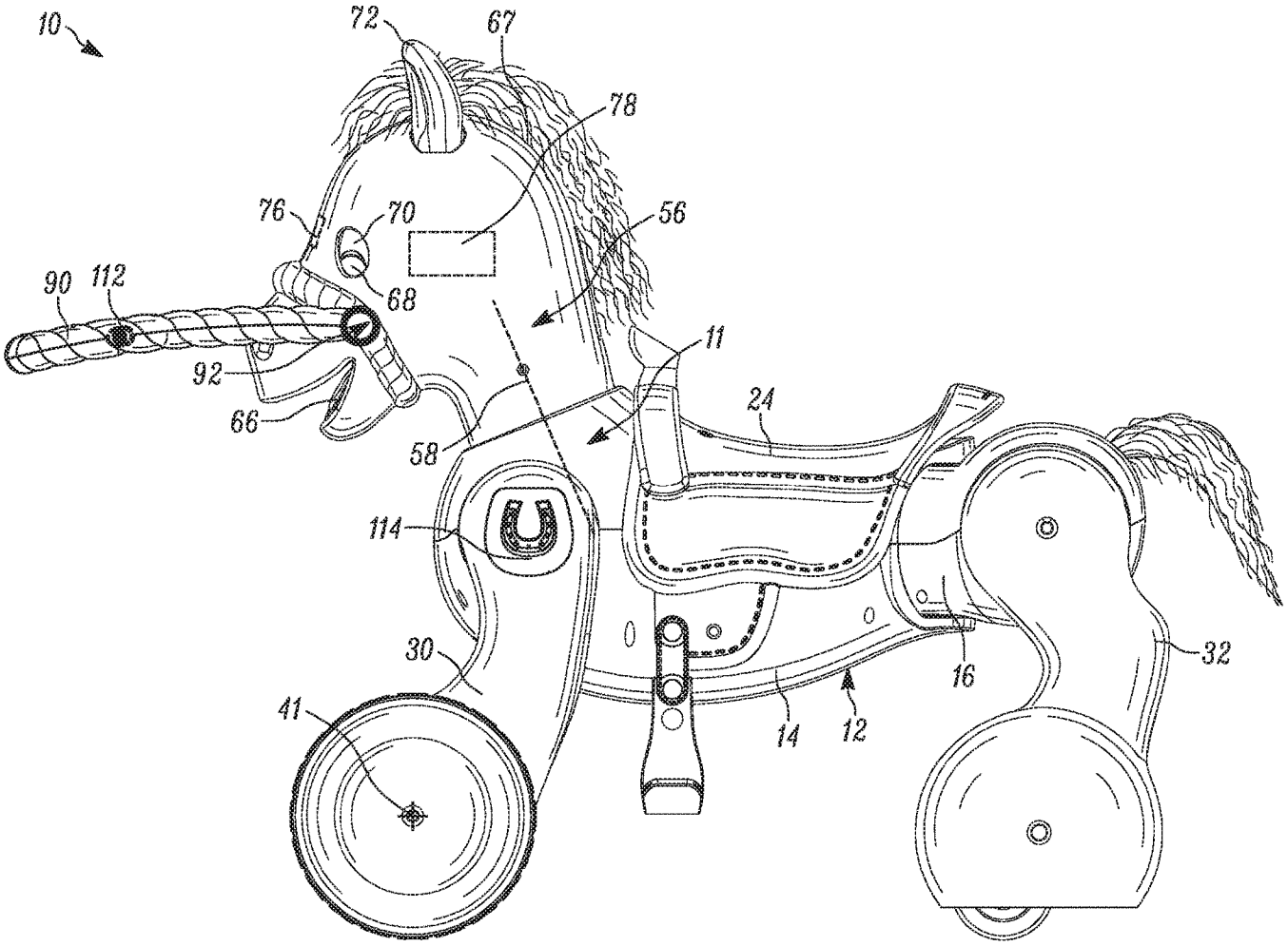
FIG. 3 is a left side view of the apparatus of FIG. 1.
Figure 4:
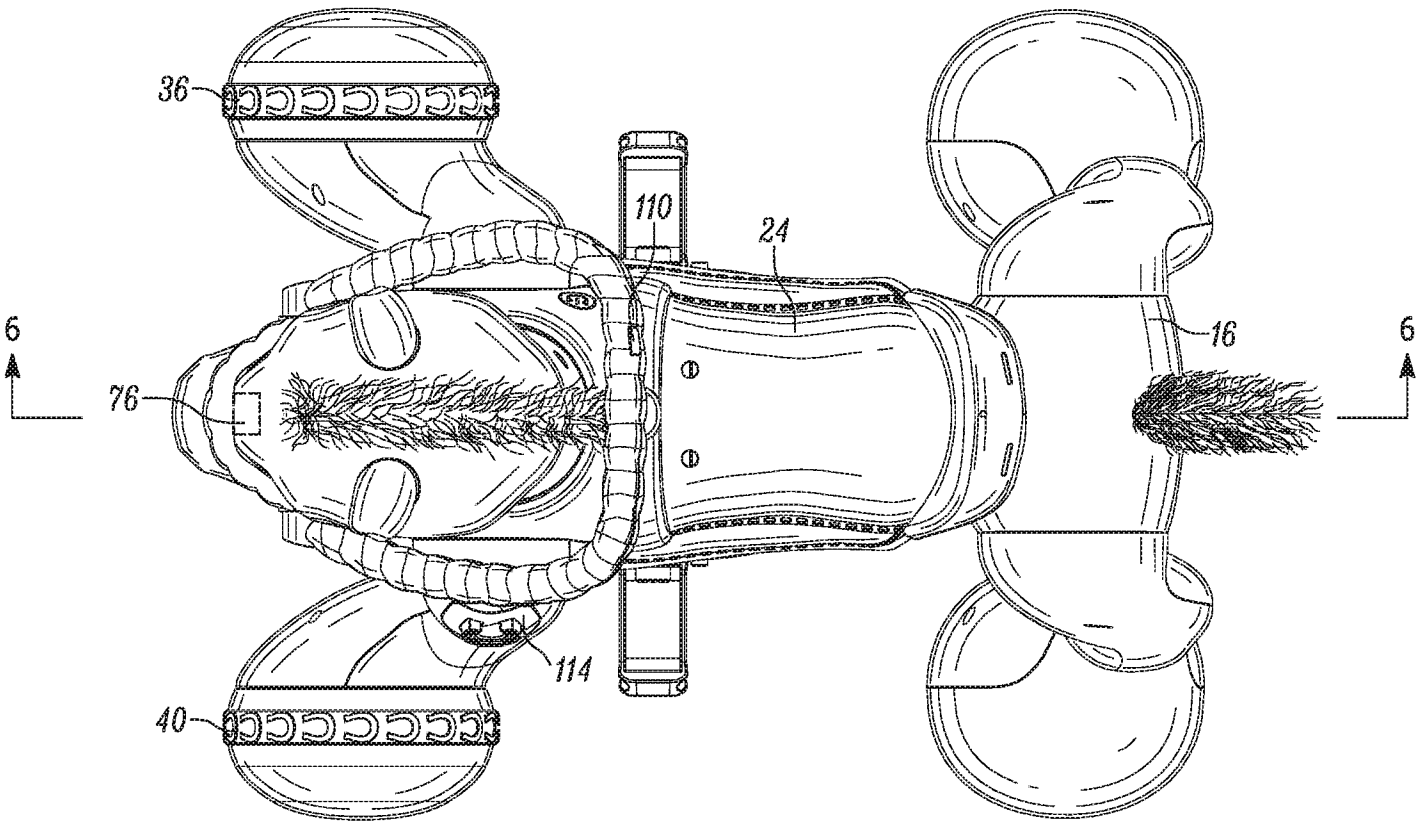
FIG. 4 is a top view of the apparatus of FIG. 1.

An exemplary motorized interactive ride-on toy apparatus 10 is disclosed and discussed herein. The apparatus 10 is a ride-on toy having various physical features, sounds, and movements that allow a child to interact with the apparatus 10 in a manner similar to a "real" animal to provide a life-like simulated interactive experience. As shown in FIGS. 1-5, an exemplary embodiment of the apparatus 10 can include a ride-on toy configured to mimic a horse. Although the illustrated and discussed embodiments reference a toy horse at times, similar structure, components, and/or functionality, in whole or in part, can be utilized with other toy characters as well, including animals and non-animals, such as a dog, dinosaur, tiger, turtle, car, doll, etc.

The apparatus 10 is sized and shaped to be ridden by a child user and includes a body 11 formed from a plurality of shell pieces, such as a head shell 13, torso shell 15, leg shell 17, etc., that are coupled to each other and/or various internal components to form the overall shape and aesthetic appearance of the apparatus 10. The apparatus 10 includes a torso 12, which in at least some embodiments, has a first torso portion 14 and second torso portion 16, which can be attached by a pivot joint 18. In at least some embodiments, the pivot joint 18 includes a vertical pivot pin 20 and a pivot spring 22 to generally bias the second torso portion 16 in alignment with the first torso portion 14, while in other embodiments, the pivot joint 18 can utilize other types of pivot mechanisms. The torso 12 includes a seat 24, which can take the shape of a saddle that included stirrups 25 for a user's feet to rest.

As shown in FIGS. 1-10, a plurality of legs are coupled to the torso 12. In at least some embodiments the apparatus 10 includes four legs extending down from the torso 12, including a first front leg 28, a second front leg 30, a first rear leg 32 and a second rear leg 34. The legs do not bend and are rigidly secured to the torso 12 to prevent or substantially prevent movement relative to the torso, although in at least some embodiments, they can be pivotably secured to the torso 12 and each leg can include a knee joint that is spring loaded to allow the legs to bend if desired.

Figure 5:
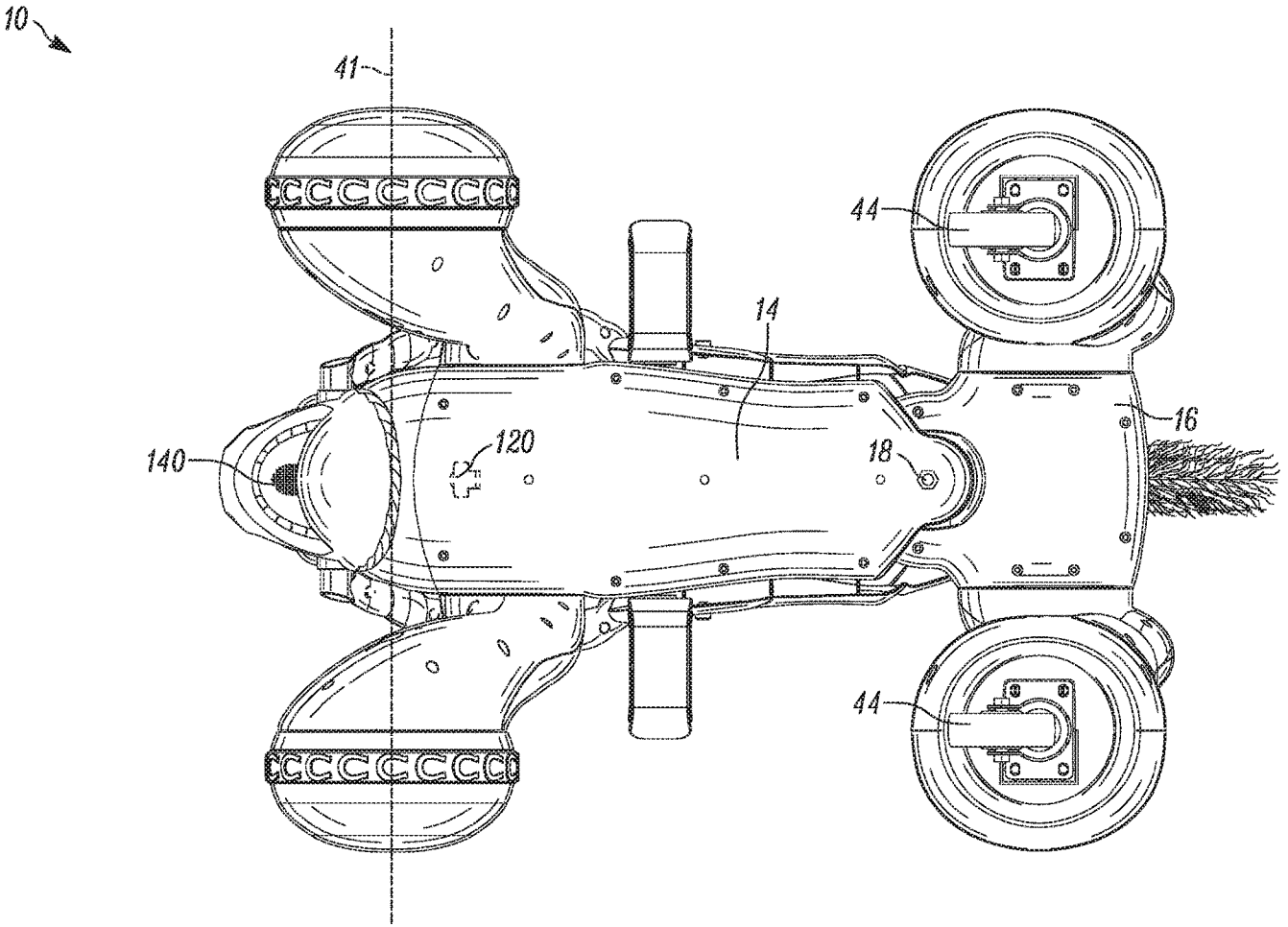
FIG. 5 is a bottom view of the apparatus of FIG. 1.
Figure 6:
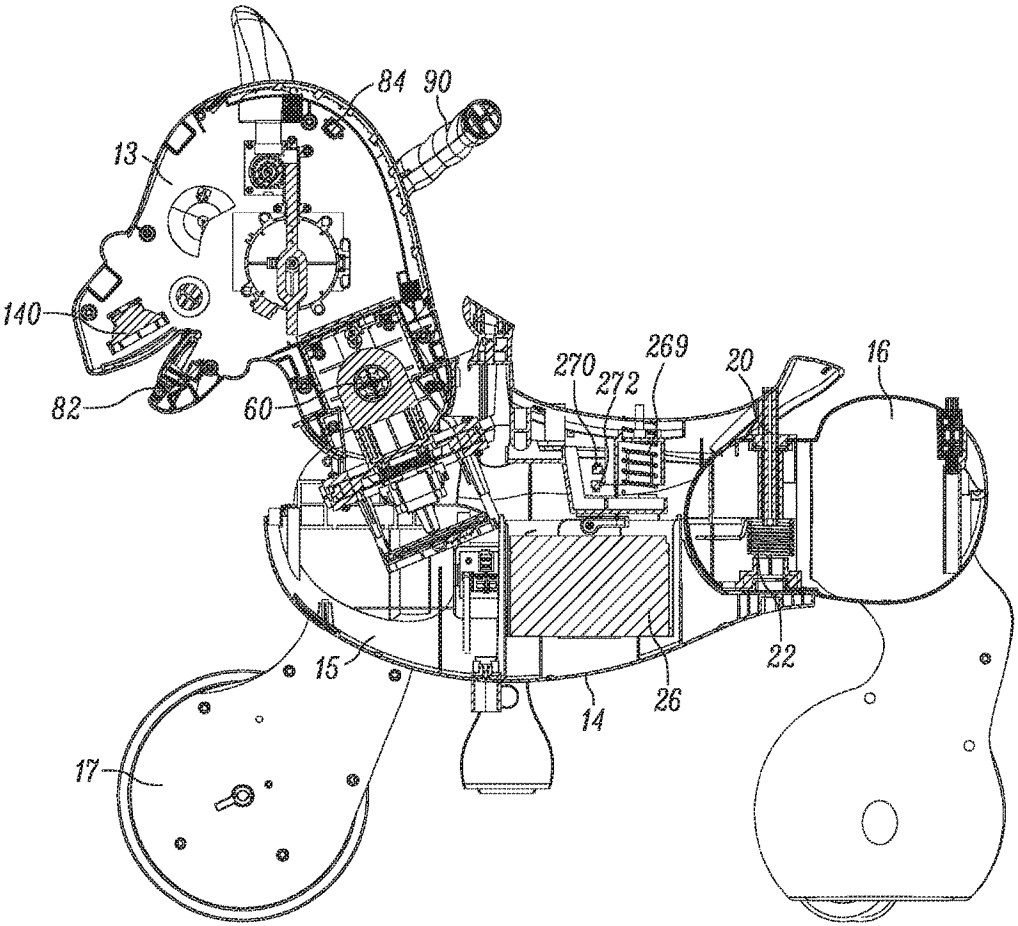
FIG. 6 is a cross-sectional left side view of the apparatus taken along line 6-6 of FIG. 4.
Figure 7:
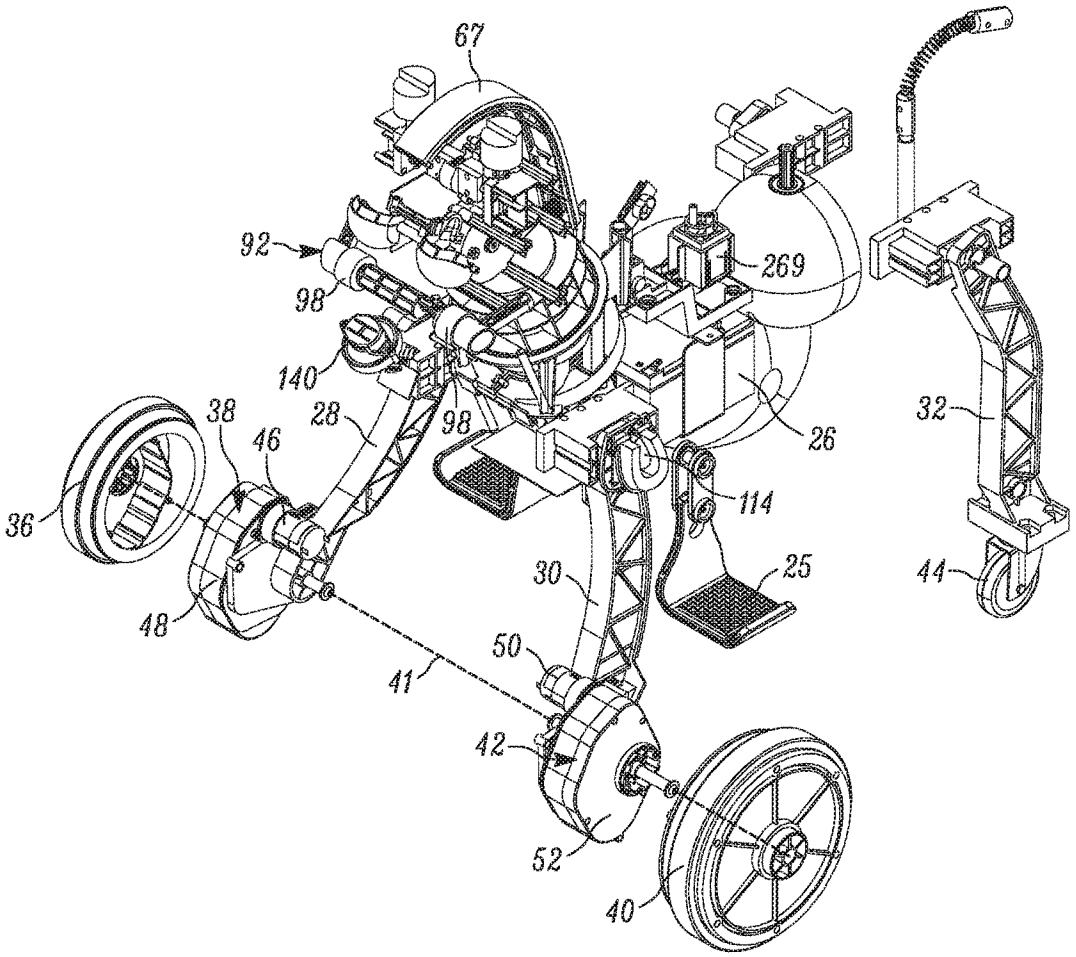
FIG. 7 is a front perspective view of the apparatus of FIG. 1 with various body portions omitted for clarity.

The apparatus 10 includes a plurality of wheels coupled to the legs, wherein the wheels allow the apparatus 10 to be propelled along a surface with or without a user thereon. To propel the apparatus 10, a plurality of the wheels are motorized. More particularly, in at least some embodiments, a first drive wheel 36 is secured to a first drive motor assembly 38 (FIG. 7), which is secured to the first front leg 28. A second drive wheel 40 is secured to a second drive motor assembly 42 (FIG. 7), which is secured to the second front leg 30. As shown in FIGS. 5 and 7, the first drive wheel 36 and second drive wheel 40 rotate about the same rotational drive axis 41. The first rear leg 32 and second rear leg 34 can include non-motorized wheels 44 secured thereto, such as freely pivotable caster-type wheels that allow the second torso portion 16 to be pulled along by the first torso portion 14 during propulsion. As shown, the first rear leg 32 and second rear leg 34 each include a separate wheel 44, while in some other embodiments, the rear torso portion 16 can be coupled to and supported by a single wheel 44.

The first and second drive motor assemblies 38, 42 can include various components, for example circuit protection devices, gears, motors, etc. In at least some embodiments, they each include a respective motor and gearbox, such as a first drive wheel motor 46, first gearbox 48, second drive wheel motor 50, second gearbox 52, while in some other embodiments, the first and second drive motor assemblies 38, 42 do not include a gearbox and the motors 46, 50 are directly coupled to the drive wheels 36, 40. Additionally, in at least some embodiments the drive wheel motors 46, 50 are direct current motors, while in other embodiments, other known types of motors can be utilized.

Figure 13:
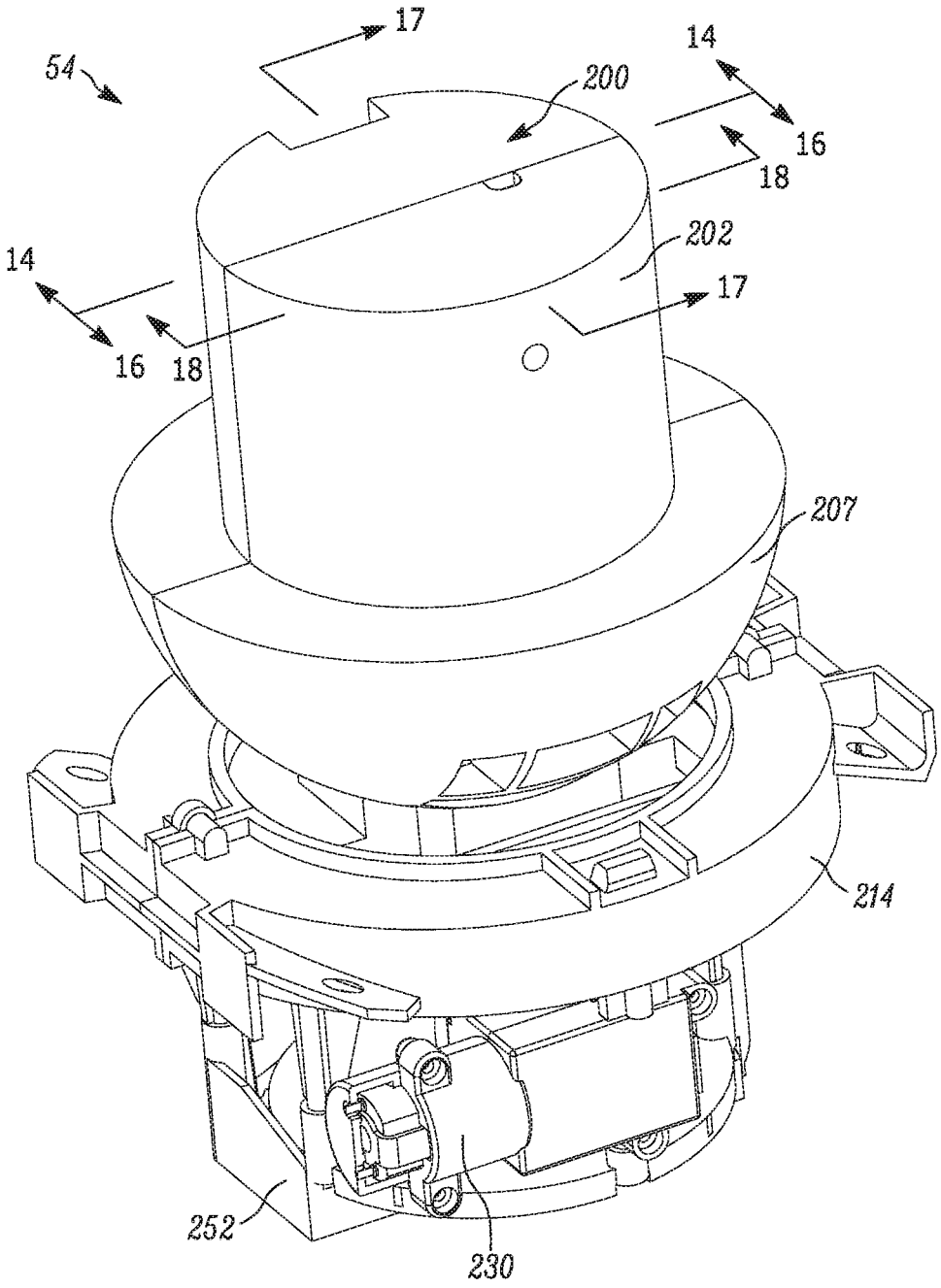
FIG. 13 is a perspective view of a motorized neck assembly of FIG. 1.
Figure 14:
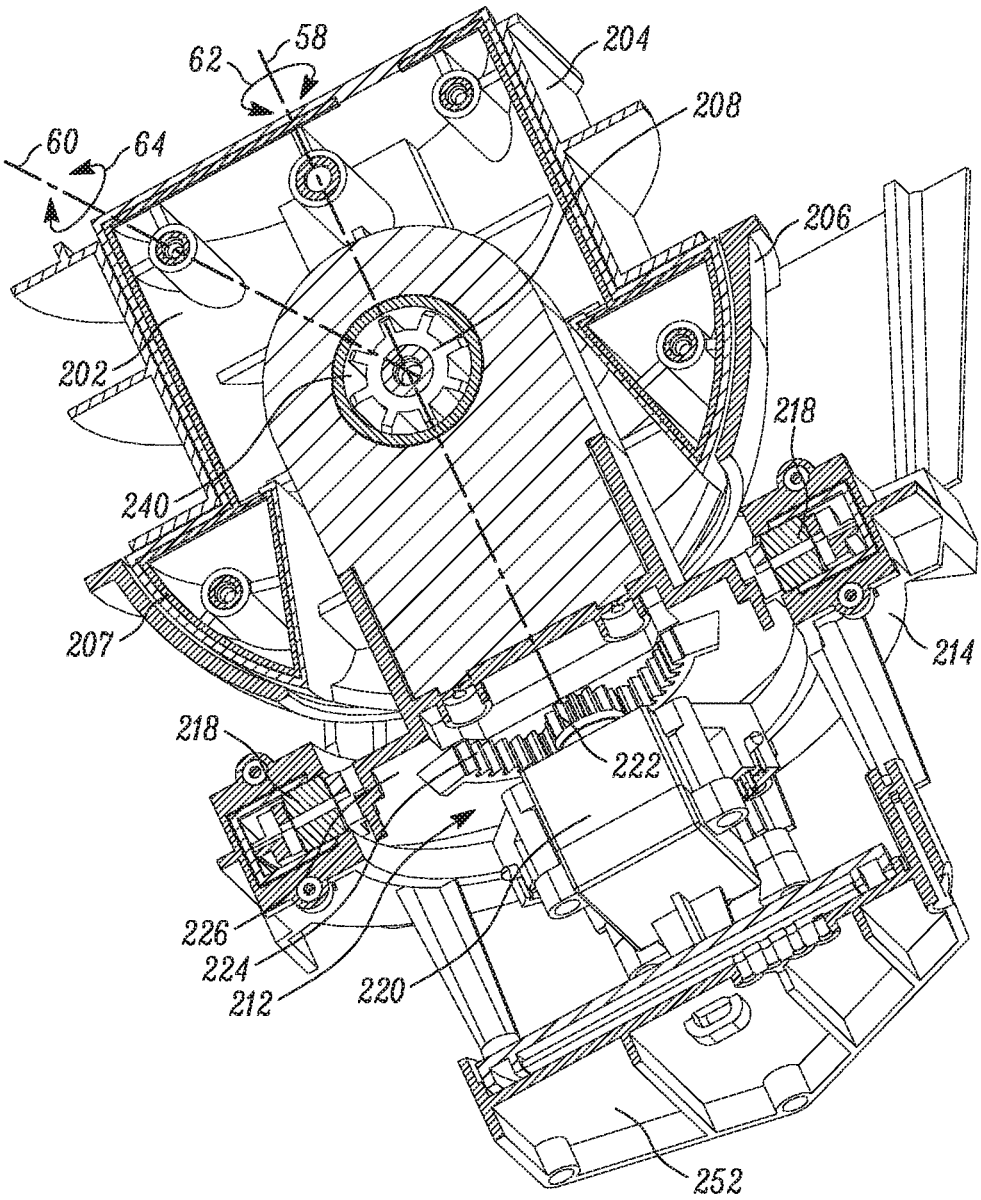
FIG. 14 is a section view of the neck assembly taken along line 14-14 of FIG. 13.
Figure 15:
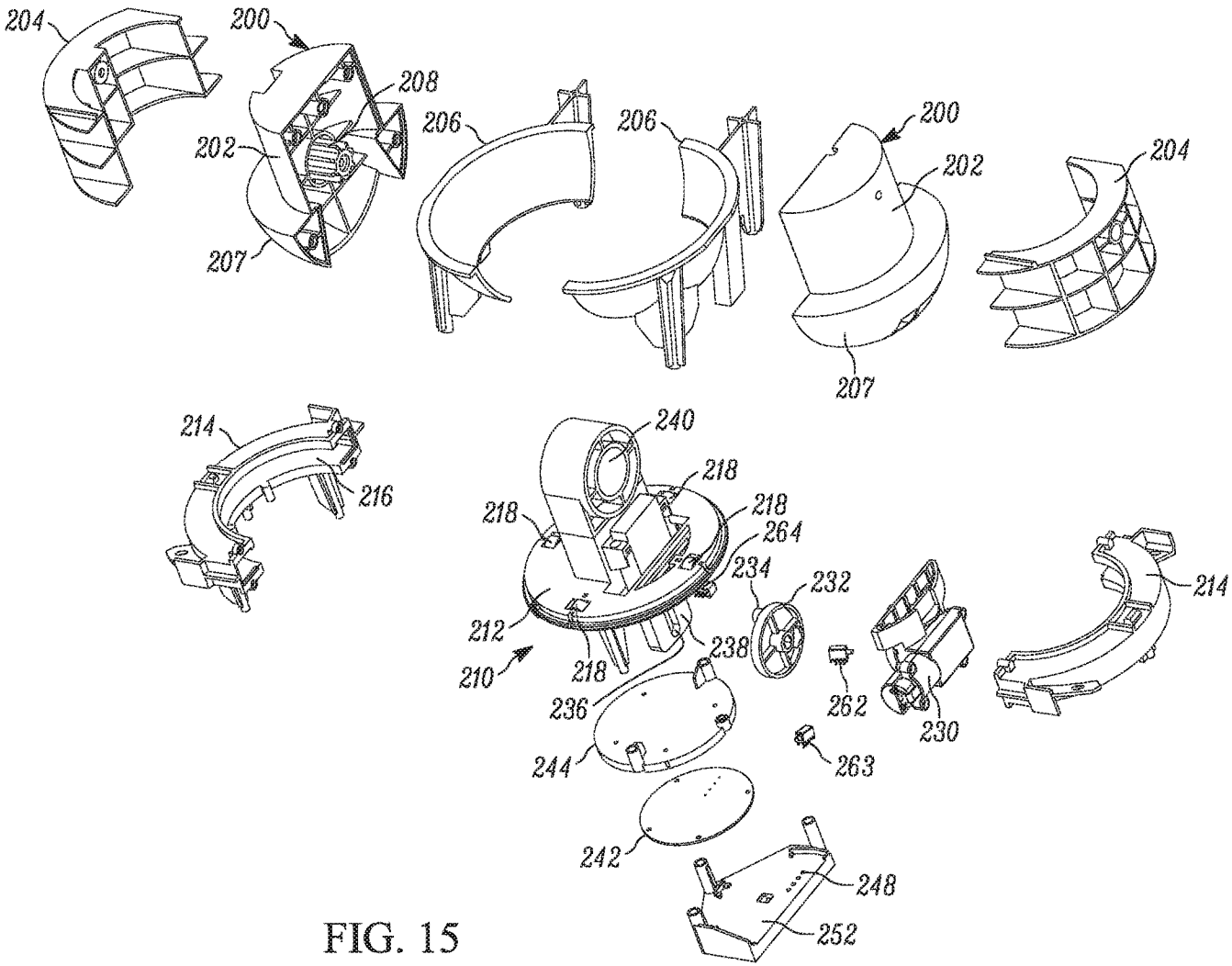
FIG. 15 is an exploded view of the neck assembly and support structure of FIG. 1.
Figure 16:
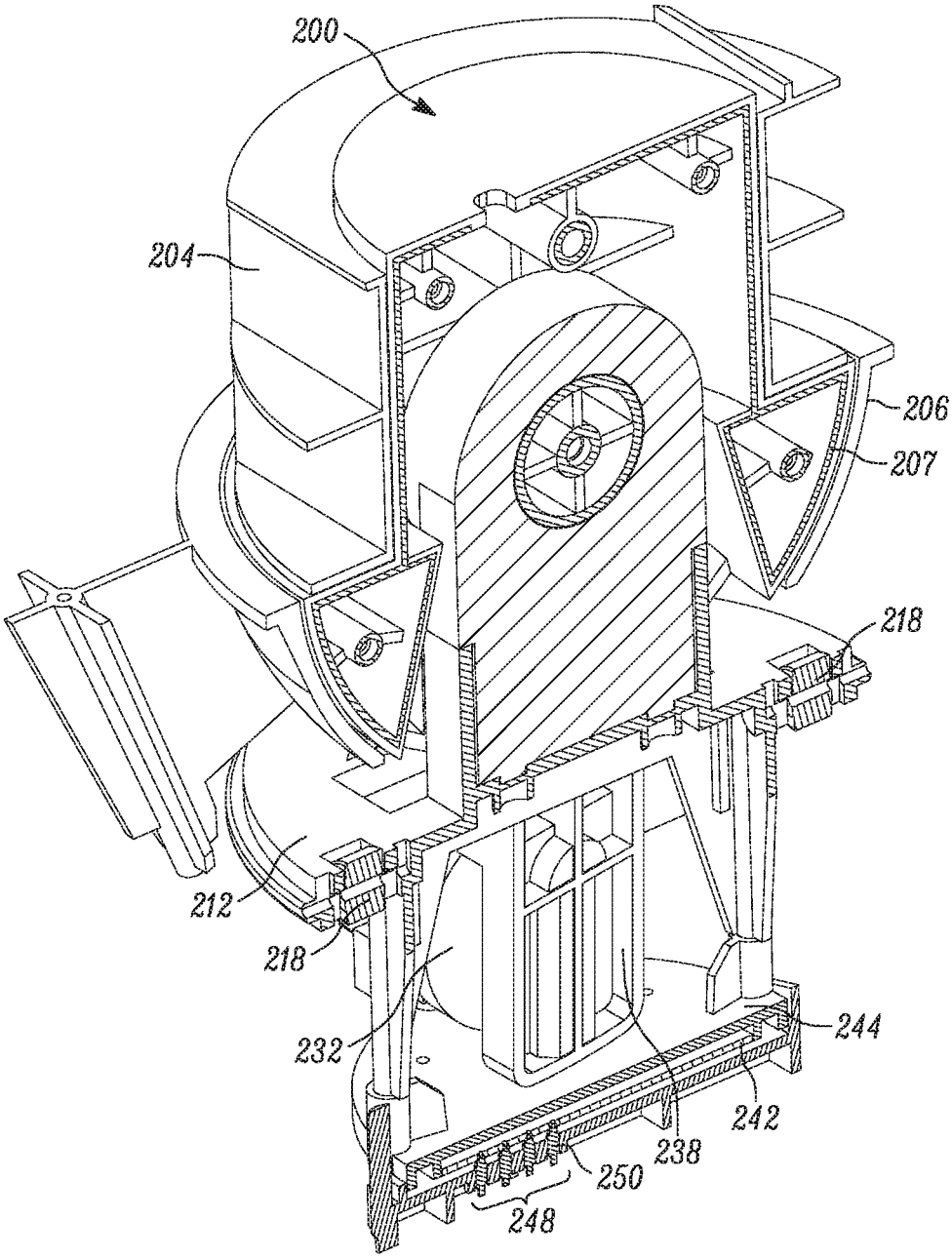
FIG. 16 is a section view of the neck assembly taken along line 16-16 of FIG. 13.
Figure 17:
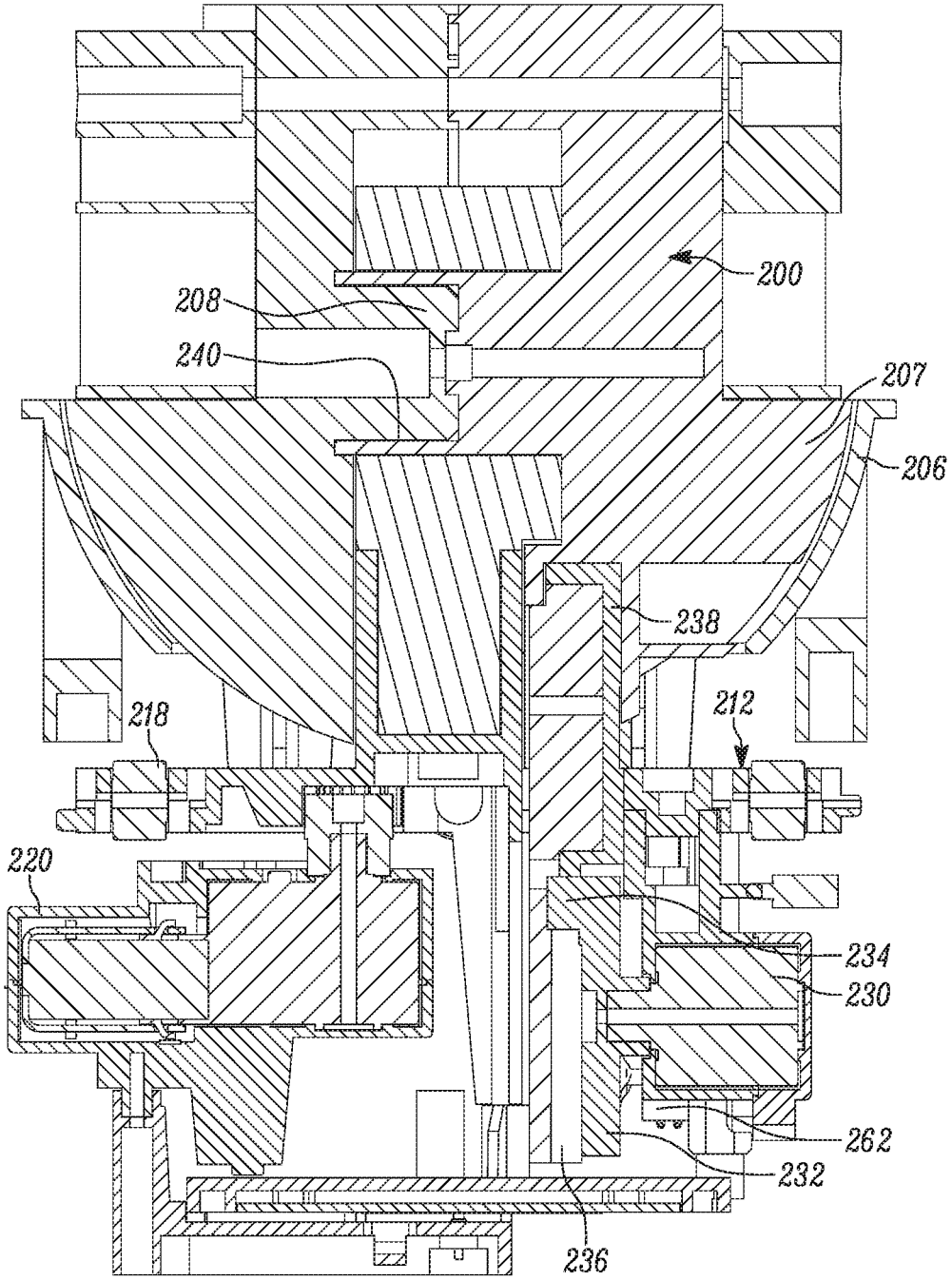
FIG. 17. is a section view of the neck assembly taken along line 17-17 of FIG. 13.

The apparatus 10 further includes a motorized neck assembly 54 (FIG. 13, discussed in detail below) coupling a head 56 to the first torso portion 14, wherein the neck assembly 54 provides selective rotational movement of the head 56 along both a first rotational head axis 58 and a second rotational head axis 60, wherein in at least some embodiments, the second rotational head axis 60 lies perpendicular to the first rotational head axis 58 and parallel to the rotational drive axis 41. Rotation of the head 56 along the first rotational head axis 58 is indicated by directional arrow 62 (FIGS. 1, 3, and 14) and provides a left side to right side movement, and rotation of the head 56 along the second rotational head axis 60 is indicated by directional arrow 64 (FIGS. 1, 6, and 14), and provides a nodding up and down movement of the head 56. In addition, in at least some embodiments, the second rotational head axis 60 lies parallel to the rotational drive axis 41.

The head 56 further includes a mouth 66, a mane 67, a pair of eyes 68, a pair of motorized eyelids 70 configured to open and close at least partially over the eyes 68, and a pair of motorized ears 72 configured to rotate. The eyelids 70 and ears 72 are actuated by a feature assembly 74 (FIG. 10) discussed in greater detail below. A plurality of touch-based sensors are included within the apparatus 10 to provide a touch input signal indicating that a user has touched a portion of the apparatus 10 (e.g., petting, brushing, feeding, etc.). The touch-based sensors can include various types of sensors, for example, capacitive, resistive, tactile, etc. Although numerous touch-based sensors can be provided in various locations throughout the apparatus 10, in at least some embodiments, the touch-based sensors can include a front head touch sensor 76, a left head touch sensor 78, a right head touch sensor 80, a mouth sensor 82, and a mane sensor 84. Further, in at least some embodiments the front head touch sensor 76, right head touch sensor 78, and left head touch sensor 80 are each capacitive-based sensors that sense a user touch, and the mouth sensor 82 and a mane sensor 84 are tactile switches that actuate when depressed by a user, such as when an object (e.g., a toy carrot) is inserted in the mouth 66, or when a user brushes the mane 67. The mane 67 is comprised of a rigid or semi-rigid material that is hinge-mounted to the head 56 by hinge pins 86 at one end to allow movement of the other end, which is spring biased away from the mane sensor 84 by a mane spring 87, such that a brushing motion on the mane 67 causes the mane sensor 84 to be activated by the downward motion of the mane 67. It is to be understood that the term touch-based sensor can be broadly construed to include various types of sensors that are activated by physical interaction with the user, as well sensors that are activated by close proximity with a user without physical interaction. In addition, it shall be understood that the terms "sensor" and "switch" can be interchangeable with the understanding that either can be utilized to communicate an indication of their position or sensed state.

Figure 9:
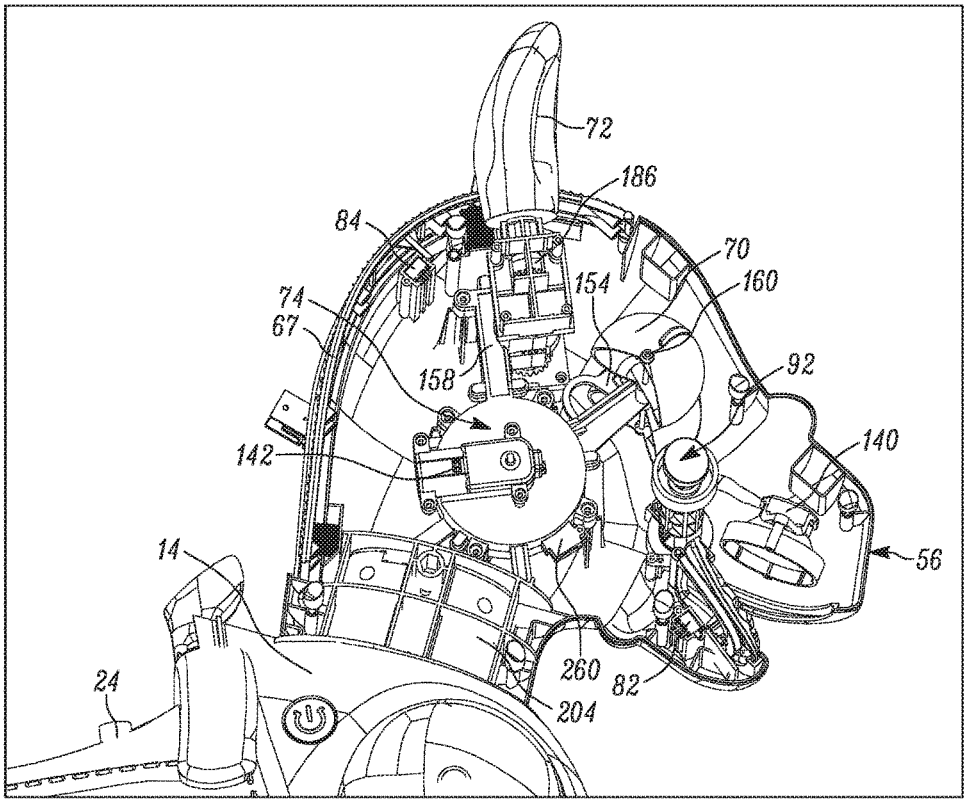
FIG. 9 is a side perspective view of the apparatus of FIG. 1 with a portion of the body removed to expose internal structure.
Figure 10:
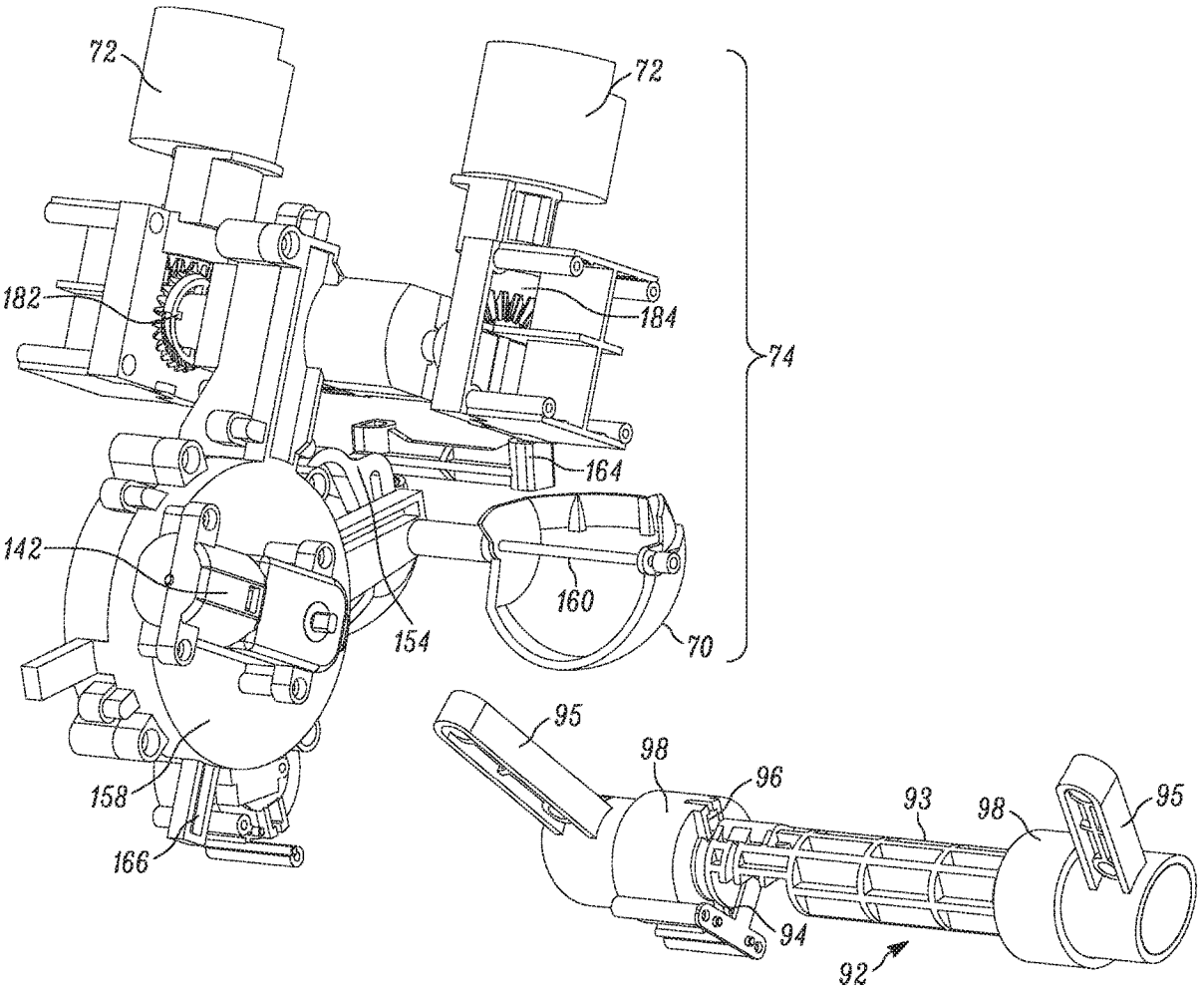
FIG. 10 is a rear perspective view of a feature assembly and reins pivot assembly of the apparatus of FIG. 1.
Figure 11:
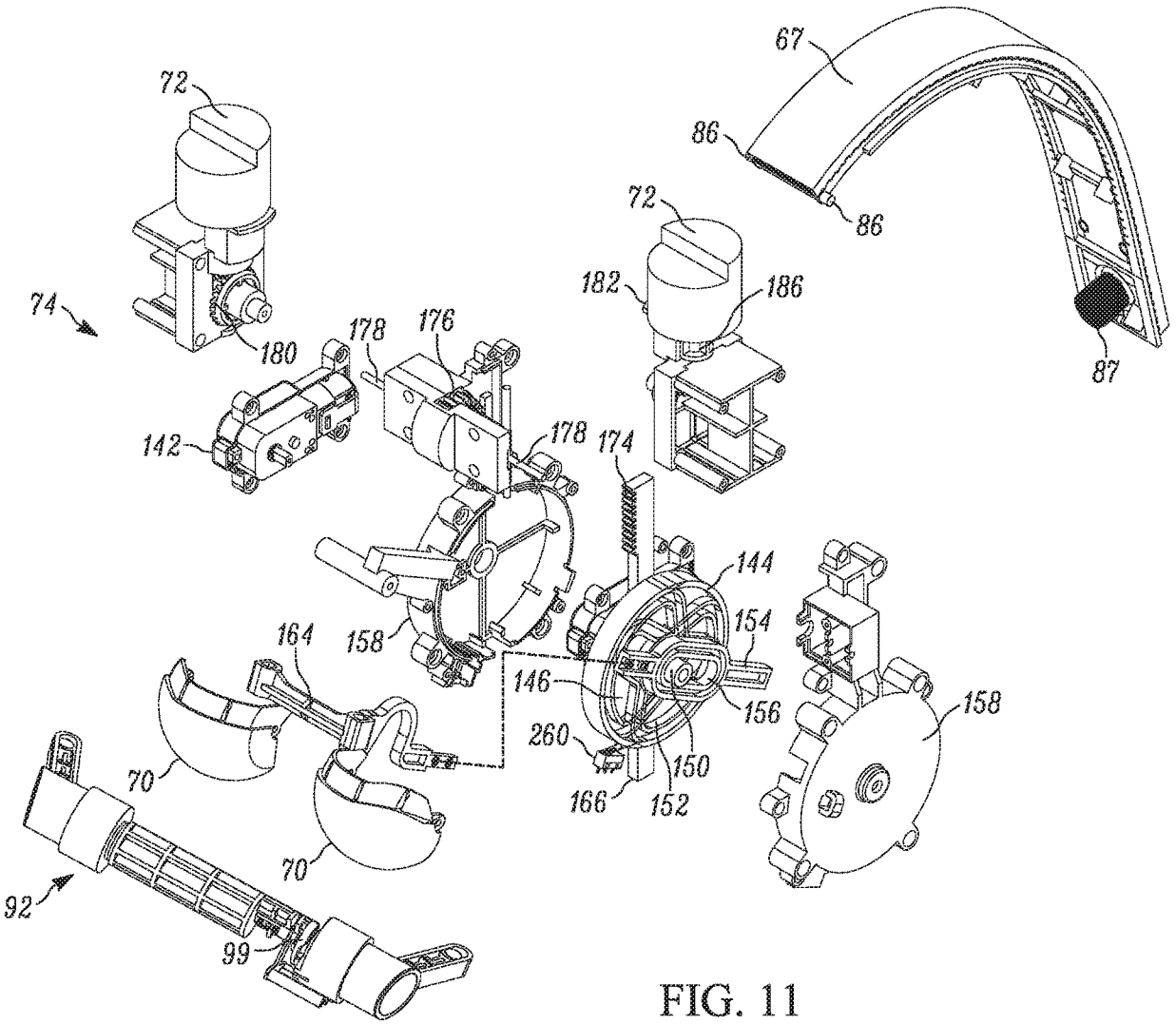
FIG. 11 is an exploded view of the feature assembly, and perspective view of the reins pivot assembly and mane of the apparatus of FIG. 1.

A mechanical steering component is provided to allow steerage of the apparatus 10 during propulsion. In at least some embodiments, to mimic a horse, the steering component is in the shape of reins 90, which are coupled to the head via a reins pivot assembly 92. The reins pivot assembly 92 allows the reins 90 to be rotated by a user between a forward position and a back position relative to the head 56. As best seen in FIGS. 9-11, the reins pivot assembly 92 includes a bit shaft 93 that has rein arms 95 on either ends that form a portion of the reins 90. The bit shaft 93 rotates within rein sleeves 98 mounted to or formed within the body 11, adjacent the mouth 66 to hold the bit shaft 93 in position relative to the mouth 66, while allowing rotation with respect to the body 11. To detect the position of the reins 90, a reins forward sensor 94 and a reins back sensor 96 are positioned at either of the rein sleeves 98 and protrude therefrom (FIG. 10), activation of either sensor 94, 96 provides a reins position input signal. The sensors 94, 96 are actuated by a bit shaft disc portion 99 during movement of the reins 90. The bit shaft disc portion 99 is shown in FIG. 11, but omitted from FIG. 10 to facilitate viewing of the sensors 94, 96. The bit shaft disc portion 99 is formed or secured to the shaft 93 to rotate with the reins, and has a varied thickness that engages the protruding sensors 94, 96 at the extents of rotation. The reins 90 further include a throttle switch 110 (for providing a throttle input signal) for user actuation to command the apparatus 10 to be propelled in a forward or reverse direction via the drive wheels 36, 40. A speed control switch 112 is also provided on the reins 90 to allow a user to select a forward or reverse speed. In at least some embodiments, the speed control switch 112 includes selections for a low forward speed (FWD1), a high forward speed (FWD2), and a low reverse speed (REV), although in other embodiments, less or additional speed settings can be provided.

The apparatus 10 includes a mode selection switch 114 for selecting various modes, such as an autonomous mode and a ride mode, and is provided on the torso 12 and can include a status light 115 (e.g., an LED) integrated therewith or separately mounted, to provide a colored indication of the selected mode or other status information. The mode selection switch 114 can be used to initiate various other actions other than mode selection, such as described in one or more sequences herein. A body tilt sensor 116 can be provided and mounted in the apparatus 10 to sense when the apparatus 10 is not in an upright position, and serves as a safety device to prevent operation of motors when not upright.

The apparatus 10 includes a rechargeable battery 118 interconnected to a charge port 120 and a charger connect switch 122. The charge port 120 is configured to receive a mating charge plug connected to a typical wall plug power supply adapter that converts household AC power to DC power. The charger connect switch 122 is physically engaged by the charge plug when inserted, causing the charger connect switch 122 to electrically disconnect the battery 118, thereby preventing battery power from activating the apparatus 10 while it is charging. In addition, a user operable main power switch 123 is included to provide a disconnect from the battery 118 to a controller 130. If the main power switch 123 is left in the ON position, thereby providing the controller 130 access to power, then the controller 130 may initiate a low power consumption sleep mode after a period of inactivity.

The controller 130 includes one or more processors to facilitate operation of the apparatus 10 using a software program stored on one or more memory devices. The controller 130 monitors the various sensors to receive status input signals and provide outputs to the various motors, speaker, light, etc. to induce action, such as motor movement, illumination, sounds, etc. based on the software program. The controller 130 can be comprised of numerous components including multiple circuit boards, integrated circuit chips (ICs), processors, memory devices, discrete components, etc., that are interconnected to communicate information and commands therebetween. As shown in the exemplary block diagram for the apparatus 10 provided in FIG. 8, the controller 130 in at least some embodiments includes a first circuit board PCB-1, which can be situated in the torso 12 and a second circuit board PCB-2 that can be located in the head 56. Each circuit board can include a processor 132 and memory device 134, with at least one of the processors 132 serving to process and implement the software program. The memory device 134 can include a discrete or processor IC embedded memory devices, and can further be comprised of any one of several known memory types, such as RAM, ROM, EPROM, EEPROM, SDRAM, etc.

In at least some embodiments, the first circuit board PCB-1 includes a GPCE4P096UA (or GPCE4P096A) IC as manufactured by GeneralPlus in Taiwan, and the second circuit board PCB-2 includes a GPC11033D (or GPC11024) IC as manufactured by GeneralPlus in Taiwan, although in other embodiments, other known ICs could be utilized to provide the functionality necessary to perform the operations described herein. These or other exemplary ICs provided can include functionality for interfacing with the described sensors to process inputs, playing sound, through the speaker 140, operate motors at varied power levels (including PWM), etc. It is to be understood that the circuit boards can include various additional components, such as resistors, capacitors, relays, fuses, solid state switches, diodes, etc. which are interconnected with each other, or other components such as the input and output devices (e.g., sensors, motors, etc.) described herein.

Further, in at least some embodiments, the memory device 134 on the first circuit board PCB-1 stores the software program for operating the apparatus 10 as described herein. The software program includes instructions for evaluating inputs from the various sensors and providing outputs to generate actions by the apparatus 10, and can include logic to perform the sequences detailed herein as well as various other functions. Although numerous actions have been detailed below with reference to various flowcharts, it is to be understood that numerous other actions can be performed and that such a listing is not intended to be exhaustive, further such actions can be modified to provide similar effects (e.g., replacing a horse's neighing sound with a dog's barking sound). In addition, the various exemplary ICs (e.g. GPCE4P096UA, GPC11033D, etc.) include pre-programmed control instructions for processing inputs and outputs as detailed in their published data sheets, which are incorporated herein by reference in their entirety. As such, the software program stored on the memory device 134 generally includes utilization of the features and instructions found on such ICs, although the stored software program could include similar features and instructions necessary to perform the various operations described herein with or without specific ICs by utilizing other or similar ICs to execute the stored software program. Further it is to be understood that the software program can take many forms and be comprised of any one of various programming languages serviceable to facilitate the described actions herein.

The software program includes pre-determined power levels for the controller 130 to provide to the motors based on various received inputs (e.g., speed selection, steering position, etc.). The controller 130 includes motor control components that provide an output of power from the battery 26 to the various motors of the apparatus 10. More particularly, electrical actuation of the motors described herein by the controller 130 can be performed using any of various combinations of solid-state and mechanical switching components and configurations. In at least one embodiment, the controller 130 can include an array of solid state relays coupled to the first drive wheel motor 46 and second drive wheel motor 50, wherein the relays are energized by a plurality of solid state switches (e.g., MOSFETS, etc.) that are switched ON/OFF by outputs from the processor 132 (e.g., GPCE4P096UA) to provide a specific polarity and selected level of power to achieve a desired speed and rotation direction. Similarly, power can be provided to the head pivot motors 220, 230 and the feature motor 142 to actuate the motors with a specific power level depending on received inputs.

The controller 130 can be configured to supply the motors with power from the battery 26 in various manners. For example, the power output from the battery 26 to a motor can be directly switched to provide a constant full or divided portion of the available battery power (e.g., a voltage divider circuit, etc.), or the power output can be a variable power level that is varied using signal modulation (e.g., pulse width modulation). Using pulse width modulation to slowly increase the average voltage level to the motors that move various body parts, such as the head 56, can result in a smooth movement of body parts, which can provide a more realistic impression of an animal movement. This is in notable contrast to direct application of a full or divided power level to a DC motor, which would result in a quick and jerky movement of the body part. Using pulse width modulation to vary the power level supplied to the drive wheel motors 46, 50 can also allow for smooth motion of the apparatus 10 along a surface, but in at least some embodiments, is not utilized. In addition, further variations of power delivery to the motors can include an initial delay, stepped levels, or intermittent delays.

The various motors described herein can include various types and configurations of motors known in the art, for example, continuous DC, stepper, and servo motors, and can include circuit protection components as desired. It shall be understood that actuation of a motor as referenced herein indicates the transmission of power to the motor to induce a rotational output therefrom.

Figure 8:
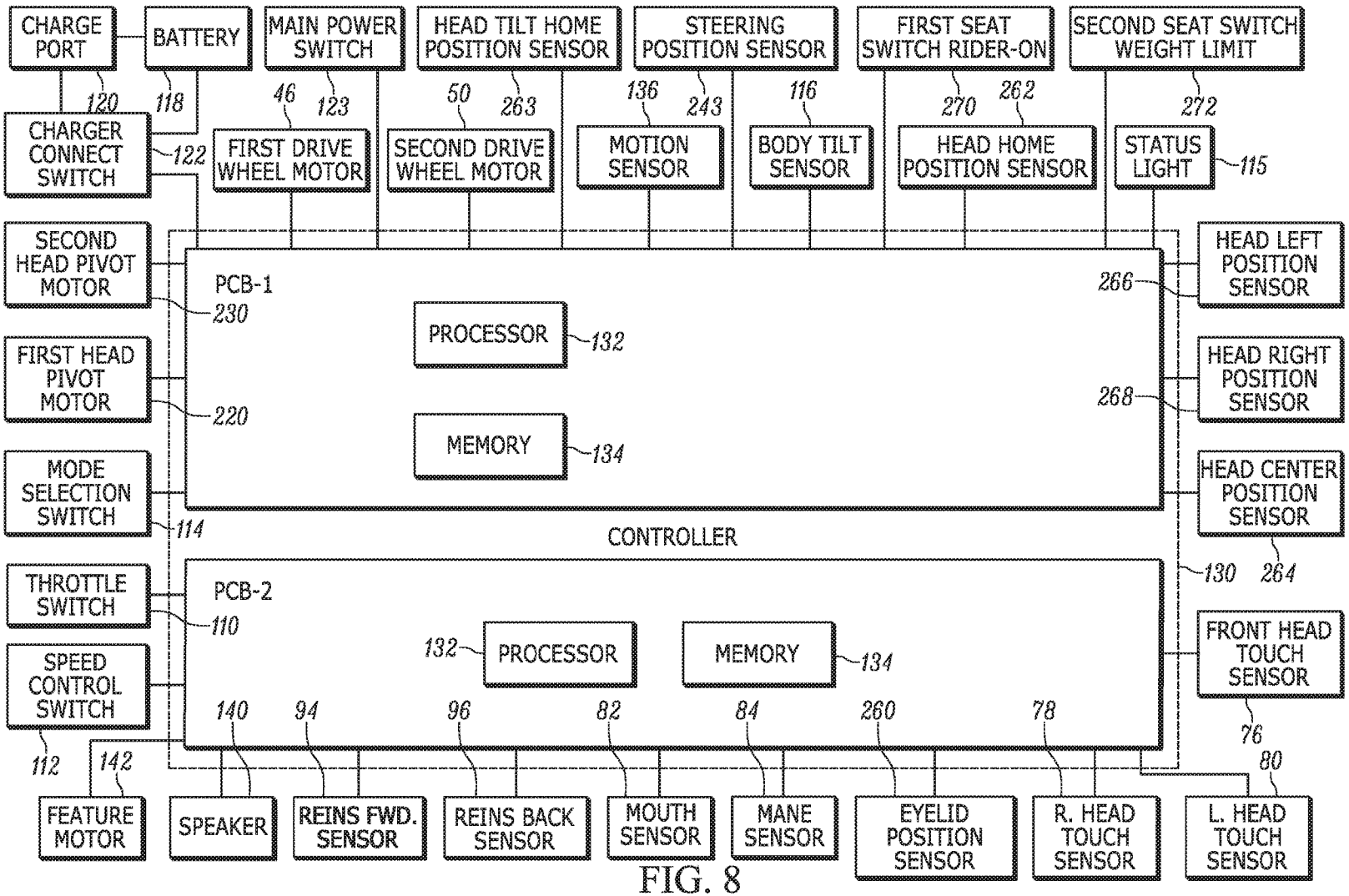
FIG. 8 is an exemplary block diagram of the electrical components of the apparatus of FIG. 1.

FIG. 8 provides an exemplary block diagram of the various interconnections between the various components found in the apparatus 10 and the controller 130. Other configurations of more or less circuit boards can be utilized to accomplish the same purpose. In addition, some of the components, such as a motion sensor 136, can include their own circuit board and IC to perform the well-known inherent function of detecting motion, as well as to receive and send the necessary inputs and outputs to the controller 130. The motion sensor 136 is in at least some embodiments an ultrasonic motion sensor that includes a transmitter and receiver, and can be positioned in the front of the first torso portion 14 to detect the presence of another object situated in front of the apparatus 10. Although an ultrasonic sensor is preferred, other sound-based motion sensors, as well as other types of motion sensors, such as light-based motion sensors can also be utilized to perform the same functions.

Figure 12:
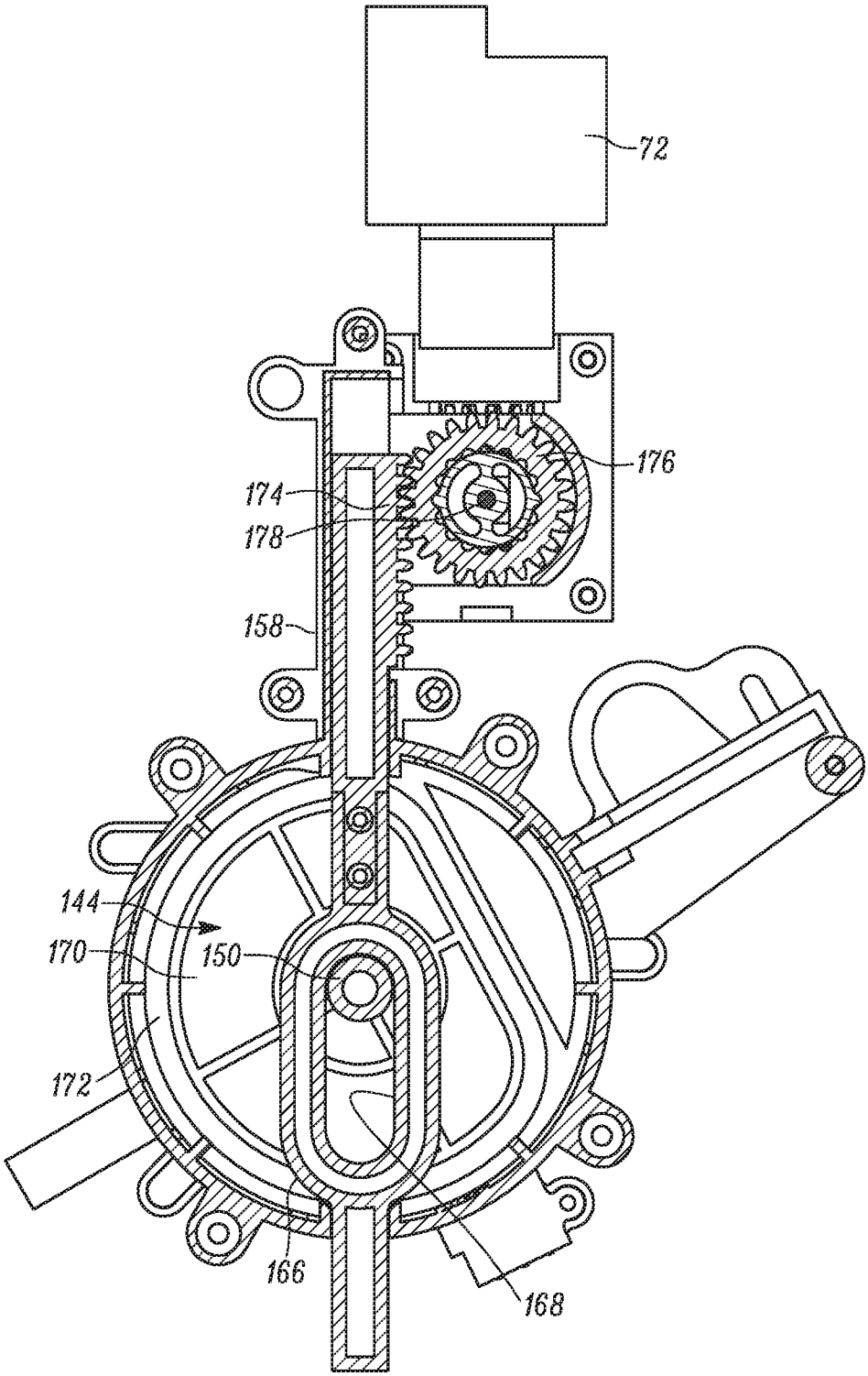
FIG. 12 is a section view of a portion of the feature assembly as viewed from the right side of the apparatus of FIG. 1.

Referring to FIG. 9, a sectional view of the head 56 is provided showing among other things, the feature assembly 74, the reins pivot assembly 92, the mane sensor 84, the mouth sensor 82, and a speaker 140. Referring additionally to FIGS. 10-12, various views of the feature assembly 74 are also provided. As noted above, the feature assembly 74 provides motorized movement of the eyelids 70 and the ears 72 via commands from the controller 130. The feature assembly 74 utilizes a feature motor 142 to perform both movements. More particularly, the feature motor 142 rotates a feature disc 144 having grooved tracks on both a first side 146 and a second side 148, and a center shaft 150 that protrudes on both sides of the feature disc 144. The first side 146 includes first tracks 152 that are engaged with an eyelid lever 154, such as by receiving therein a protruding post extending perpendicularly from the eyelid lever 154, such that it can only move within the first tracks 152. The eyelid lever includes an oblong center portion 156 sized to engage with the center shaft 150 and allow for only rotational and longitudinal movement therewith. The eyelids 70 are each rotatably secured to an eyelid pivot rod 160 at their center, and further secured to a bar portion 164 of the eyelid lever 154. As the feature motor 142 rotates the feature disc 144, the eyelid lever 154 is moves longitudinally towards and away from the center shaft 150 as directed by the first side tracks 146, causing the eyelid lever 154 to be moved in and out relative to the feature assembly housing 158 (which is shown as two separate halves), thereby pushing and pulling the bar portion 164 to cause the eyelids 70 to rotate on the eyelid pivot rod 160. Rotation of the ears 72 is performed by a series of gear interactions that begin with an ear lever 166 that includes an oblong center portion 168 sized to engage with the center shaft 150 and allow for only rotational and longitudinal movement therewith. The second side 170 of the feature disc 144 includes second tracks 172 that are engaged with the ear lever 166, such as by receiving therein a protruding post extending perpendicularly therefrom, such that rotation of the feature disc 144 causes the ear lever 166 to be moved as directed by the second tracks 172, causing the ear lever 166 to be moved in and out (up and down) relative to the feature assembly housing 158. As best shown in FIG. 12, the ear lever 166 includes an upper toothed portion 174 that engages a toothed center gear 176 via enclosure by the feature assembly housing 158. The center gear 176 is fixed to a center rod 178 along with first and second end gears 180, 182, such that rotation of the center gear 176 by the ear lever 166 causes the first and second end gears 180, 182 to rotate. The first and second end gears 180, 182 are further rotatably engaged with first and second ear gears 184, 186, which are attached to the ears 72. It is noted that for clarity only a portion of the ears 72 are shown in FIGS. 10-12.

Referring now to FIGS. 13-19, the motorized neck assembly 54 is illustrated in an exemplary perspective view. FIGS. 14-19 further illustrate the neck assembly 54 of FIG. 13 along with a head collar 204 and a neck sleeve 206. The neck assembly 54 includes a head pedestal 200 having a cylindrical pedestal upper portion 202 sized and shaped to be secured to a mating head collar 204, and a partially spherical pedestal lower portion 207 sized and shaped to move at least partially within the neck sleeve 206, noting that various other shapes and sizes can be utilized for these components and still allow for the described functionality. The head collar 204 is formed with or otherwise secured to the head 56 to allow the head 56 to be installed and secured to the head pedestal 200. The head pedestal 200 also includes a central pivot arm 208 extends along the second rotational head axis 60.

The neck assembly 54 further includes a head pivot base 210 having a pivot disc portion 212 that is rotatably supported and secured to a base ring 214. The base ring 214 and the neck sleeve 206 are each secured to the first torso portion 14, and provide support for the neck assembly 54, while allowing movement of the head 56 along multiple axes. The base ring 214 includes an interior circular channel 216 sized and shaped to enclose and support a plurality of disc rollers 218 positioned along the pivot disc portion 212, thus allowing the head pivot base 210 to rotate relative to the base ring 214, and therefore relative to the first torso portion 14. To facilitate rotation of the head pivot base 210, a first head pivot motor 220 (FIG. 14) is secured to the base ring 214, wherein the first head pivot motor 220 includes a first pivot gear 222 that engages an arced gear wall 224 formed on the bottom side 226 of the pivot disc portion 212. Actuation of the first head pivot motor 220 by the controller 130 causes the pivot disc portion 212, as well as the head pedestal 200 and head 56 coupled thereto, to be rotated left or right about the first rotational head axis 58.

Figure 18:
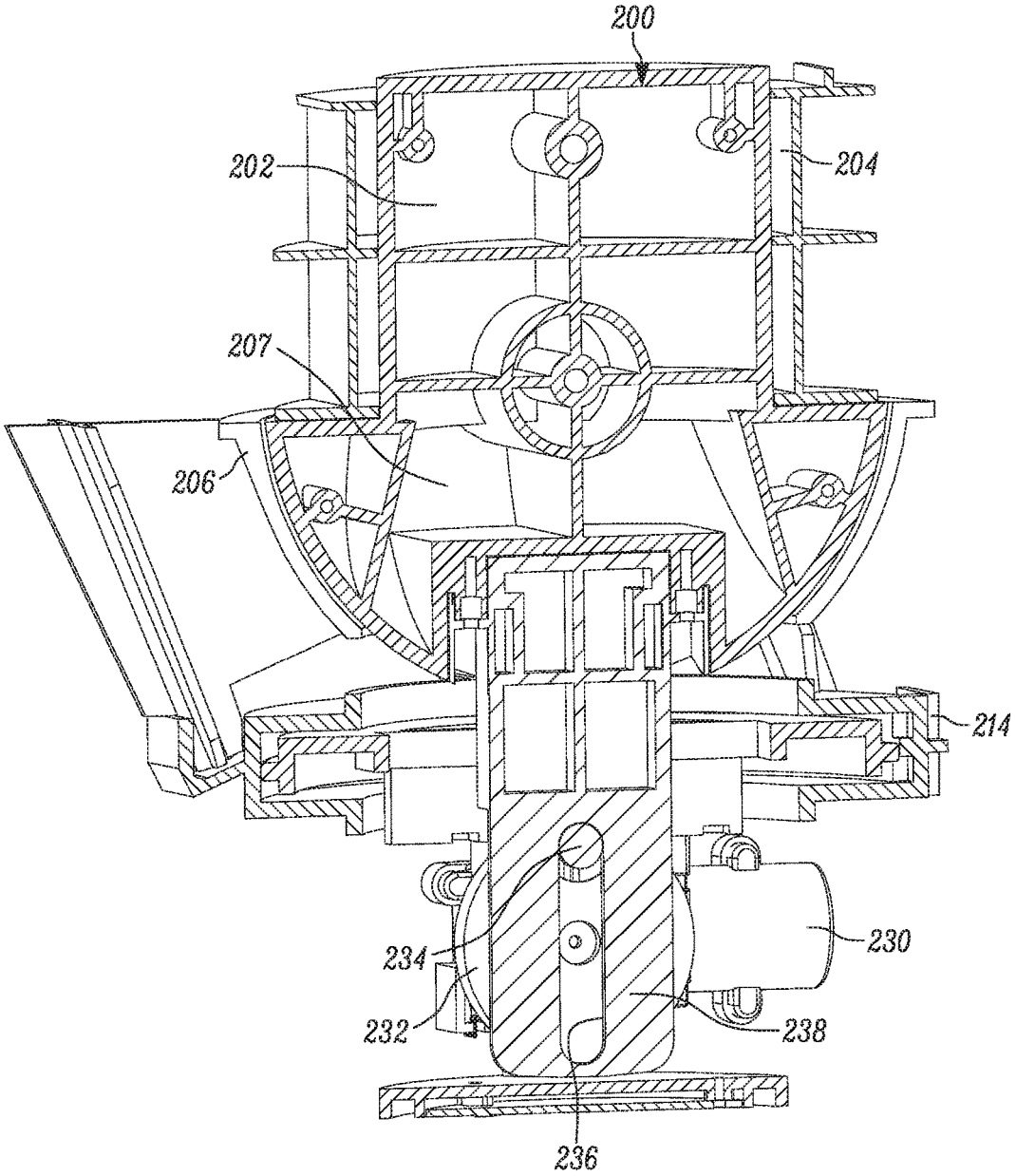
FIG. 18. is a section view of the neck assembly taken along line 18-18 of FIG. 13.
Figure 19:
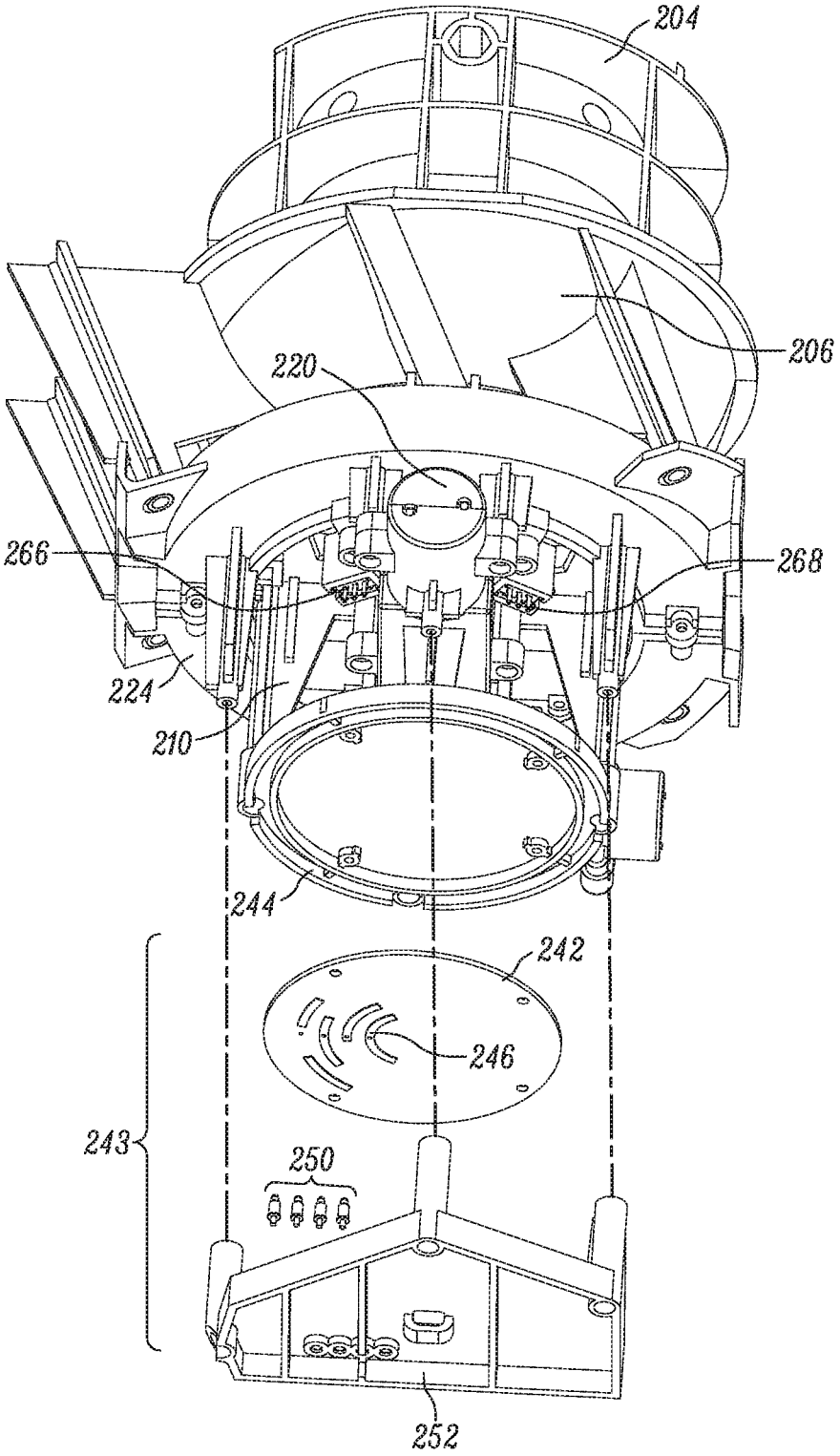
FIG. 19. is a partially exploded bottom perspective view of the neck assembly of FIG. 15.

Referring further to FIGS. 13-19, to facilitate rotation of the head 56 about the second rotational head axis 60, a second head pivot motor 230 is provided. The second head pivot motor 230 is mounted to the base ring 214 and includes a rotatable lever disc 232 that rotates upon actuation of the second head pivot motor 230 by the controller 130. The lever disc 232 includes a disc post 234 that rides inside a longitudinal channel 236 of a lever arm 238, wherein the lever arm 238 extends upward and is secured to the head pedestal 200 (FIG. 18). The pivot arm 208 of the head pedestal 200 is rotationally situated within a base sleeve 240 of the head pivot base 210 (FIG. 15), and thereby provides the second rotational head axis 60 for the head 56 to rotate relative to the first torso portion 14. More particularly, when the second head pivot motor 230 is actuated by the controller 130, the rotating lever disc 232 causes the lever arm 238 to move forward or backwards, thereby causing the head pedestal 200 and the attached head 56, to rotate about the second rotational head axis 60. As described, the first head pivot motor 220 and second head pivot motor 230 can be utilized to selectively rotate the head 56 in multiple directions (multi-directional), including clockwise and counter-clockwise (a.k.a. right and left, per directional arrow 62 of FIGS. 1 and 14) using the first head pivot motor 220, and up and down (per directional arrow 64 of FIGS. 1 and 14) using the second head pivot motor 230. Further, as separate motors are used for separate rotations, the motors can be actuated simultaneously to provide compound movement of the head 56 along both the first rotational head axis 58 and the second rotational head axis 60.

In addition to providing motorized movement of the head 56, the neck assembly 54 also includes an integrated electrical steering position sensor 243 (FIG. 19) that translates a mechanical steering input via manual rotation of the head 56 by a user, into an electronic steering position signal that is communicated to the controller 130. More particularly, a steering position disc 242 is mounted to the head pivot base 210 via a disc mount 244. The steering position disc 242 includes a plurality of progressively spaced arced contact strips 246. A contact sensor array 248 comprised of a row of contacts 250 are provided on a lower mount 252, which is secured to the base ring 214, with the contacts 250 wired to the controller 130 to provide a conduction signal for each contact 250. As the contact sensor array 248 is fixed in position, and the contact strips 246 rotate with the head pivot base 210 while a user turns the head 56, rotation of the head 56 causes the contact sensor array 248 to lose or gain contact with specific contact strips 246, whereby the spacing of the contact strips 246 allows the contact sensor array 248 to sense when the head is rotated a specific number of degrees to either the left or to the right based on which contact strip 246 is sensed based on the conductivity of each contact 250. In at least some other embodiments, other types of position sensing mechanisms can be utilized as well, such as a potentiometer, rotary encoder, etc.

To provide further verification of the position of various components such as the head 56, eyelids 70, etc., various additional position sensors can be provided. Such position sensors can include an eyelid position sensor 260 (FIG. 11) that confirms when the feature motor 142 is situated to position the eyelid in a closed or open position, a head home position sensor 262 (FIG. 15) to detect when the head 56 is fully rotated upwards from the ground, a head tilt home position switch 263 positioned opposite the head home position sensor 262 to detect when the head 56 is fully rotated towards the ground, a head center position sensor 264 to detect when the head 56 is centered (facing straight forward), a head left position sensor 266 (FIG. 19) to indicate when the head 56 is fully rotated to the left, and a head right position sensor 268 (FIG. 19) to indicate when the head 56 is fully rotated to the right. In addition, a spring-biased seat mount 269 can be positioned under the seat 24, wherein the seat mount 269 includes a first seat switch 270 and a second seat switch 272. The first seat switch 270 can detect when a user is sitting on the seat 24 and satisfies a predetermined acceptable weight limit, thereby providing a rider detected input signal, wherein the second seat switch 272 can be calibrated to detect when a user sitting on the seat exceeds the predetermined acceptable weight limit. Both switches 270, 272 can send an input signal to the controller 130 and used as a control parameter for enabling and disabling various operations.

The apparatus 10 includes various modes of operation, such as autonomous mode and drive mode that provide interactive experiences for a user. When in drive mode, use of the steering position sensor 243, the throttle switch 110, and the speed control switch 112 allow a user to propel the apparatus 10 in a chosen direction by utilizing the first and second drive motor assemblies 38, 42 to rotate the drive wheels 36, 40. The user can either be sitting on the seat 24 with the reins 90 in a back position to experience a ride by the apparatus 10, or can rotate the reins 90 to a forward position and guide the apparatus 10 to follow the user.

As discussed above, the apparatus 10 can be steered by the reins 90. When a user wishes to steer the apparatus 10 in a specific direction, the reins 90 are used to rotate the head 56 to the left or right along the first rotational head axis 58. As the steering position sensor 243 can detect numerous angles of rotation of head positions, the further the head 56 is rotated to the left or right, the more steering control is provided by the controller 130. As such, the controller 130 proportionally varies applied power from the battery 26 to the first drive motor assembly 38 and the second drive motor assembly 42 based on the steering position signal. In at least some embodiments, the steering position sensor 243 can detect several distinct positions, which can include: a center position (head is not rotated and pointed straight ahead—zero degree rotation), three positions of rotation to the left based on increasing degrees of rotation (L1, L2, L3) relative to center, and three positions of rotation to the right based on increasing degrees of rotation (R1, R2, R3). The positions extend over several degrees in both left and right rotation directions and can be adjusted as desired during programming. For example the first left position L1 can extend from 1-10 degrees rotation to the left from center (zero degrees), second position L2 from 11-15 degrees, and the third position L3 from 15-25 degrees. Similarly, the first right position R1 can extend from 1-10 degrees rotation to the right from center, second position R2 from 11-15 degrees, and the third position R3 from 15-25 degrees. As such, when a user moves the reins 90 to mechanically rotate the head 56 (similar to riding a real animal) and thereby directs the apparatus 10 to move in a specific direction, the steering position sensor 243 provides an electronic position signal to the controller 130 indicating the user's desired direction.

To move the apparatus 10 the user first selects a desired speed/direction from the speed control switch 112. FWD1 is a forward low speed and therefore would require the controller 130 provide a first level of power to the first and second drive wheel motors 46, 50 to propel the apparatus 10. FWD2 is a high speed and therefore would require the controller 130 to provide a second level of power that is greater in than the first level in order to propel the apparatus 10 at a higher speed. When REV is selected, the controller 130 provides a low level of power similar to low speed, but with an opposite rotation direction from FWD1 and FWD2 to propel the apparatus 10 in reverse.

When the head 56 is at the center neutral position, no steering instruction is provided and therefore when a user actuates the throttle switch 110 the controller 130 actuates (i.e., causes a rotational output) both first and second drive wheel motors 46, 50 simultaneously with equal power levels. As the first and second drive wheels 36, 40 are both in the front and on the same rotational drive axis 41, the apparatus 10 moves in a straight or substantially straight direction, with the rear torso portion 16, merely following the direction of the front torso portion 14. If the user wishes to steer the apparatus 10 in a specific direction then the output power provided by the controller 130 would be different between the first and second drive wheel motors 46, 50. More particularly, to effectuate steering of the apparatus 10 in a chosen direction, the controller 130 reduces or eliminates the power level provided to the inside drive wheel so that it rotates slower than the outside drive wheel.

The controller is configured with predetermined power level ratios for applying power to the first and second drive wheel motors 46, 50 based on the steering angle and the speed and direction setting, namely L1-L3, R1-R3, FWD1, FWD2, and REV. For example, when the head 56 is rotated left (user moves the reins to their right) to the first sensed position (L1), a predetermined level of power for L1 is transmitted from the controller 130 to the first drive wheel motor 46 (right side wheel) and a lesser predetermined level of power for L1 is transmitted from the controller 130 to the second drive wheel motor 50 (left side wheel), the disparity in power causes the apparatus 10 to begin to turn left, of course the amount of power reduction provided to the left side wheel determines the rate at which the apparatus 10 will turn left, therefore, if a user turns the head further to the left to L2, the power reduction to the left side wheel is increased, and so on for L3. In addition to the option of providing a reduced power level to the left side wheel, it may be desired or necessary to cease all power or even apply a reverse power to the second drive wheel motor 50 in order to slow the left side wheel down sufficiently to facilitate a desired turning action.

Steering the apparatus 10 to the right follows a similar principal, except that the right side wheel must now be slowed to effectuate a right hand turn. More particularly, when the head 56 is rotated right (user moves the reins to their left) to the first sensed position (R1), a predetermined level of power for R1 is transmitted from the controller 130 to the second drive wheel motor 50 (left side wheel) and a lesser predetermined level of power for R1 is transmitted from the controller 130 to the first drive wheel motor 46 (right side wheel), the disparity in power causes the apparatus 10 to begin to turn right, of course the amount of power reduction provided to the right side wheel determines the rate at which the apparatus 10 will turn right, therefore, if a user turns the head further to the right to R2, the power reduction to the right side wheel will be increased, and so on for R3. In addition to the option of providing a reduced power level to the right side wheel, it may be desired or necessary to cease all power or even apply a reverse power to the first drive wheel motor 46 in order to slow the right side wheel down sufficiently to facilitate a desired turning action. The predetermined levels of power that the software program utilizes for each steering position, as well as FWD1, FWD2, and REV, can be chosen based on numerous factors, such as the overall weight of the apparatus 10, the allowable user weight, the power output of the battery, and so on, therefore these power levels will be relative to each other to perform their chosen function, but can all be higher or lower depending on various design choices.

In addition to being self-propelled, the apparatus 10 includes numerous other interactive features, which can be performed simultaneously or separately. As the apparatus 10 is capable of performing various actions to provide an interactive experience, such as motorized head rotation, body propulsion, eyelid blinking, emitting of animal specific sounds, dancing, etc., sequence tables have been provided in FIGS. 24A-24B, and 25A-25D that detail various exemplary sequences that can be executed by the controller 130. Although not exhaustive, many of the sequences are further detailed in the various flowcharts provided in FIGS. 20-23D. These flowcharts can also include various global functions that dictate safe operation of the apparatus 10, noting that for example, if at any time the body tilt sensor 116 or the second seat switch 272 (overweight limit) are sensed as on, the controller 130 immediately cease power to all the motors and go to distress mode. The sequence tables provide a sequence name (e.g., SEQ_RideOnStart) followed by a row of actions to be executed for that specific called Sequence. More particularly, the sequence tables include the following columns: Sequence (reference name of the sequence); Audio Content (specific sound file played through the speaker 140); Motor Description (describes head or body motor movements (e.g., first or second pivot motor actuation, first and second drive wheel motor actuation)); and Eyes (indicates eyelid movement via the feature motor 142). The sequence tables in FIGS. 24-25D are merely exemplary and each sequence described can include less or more actions, occurring in the same or varied orders.

Figure 20:
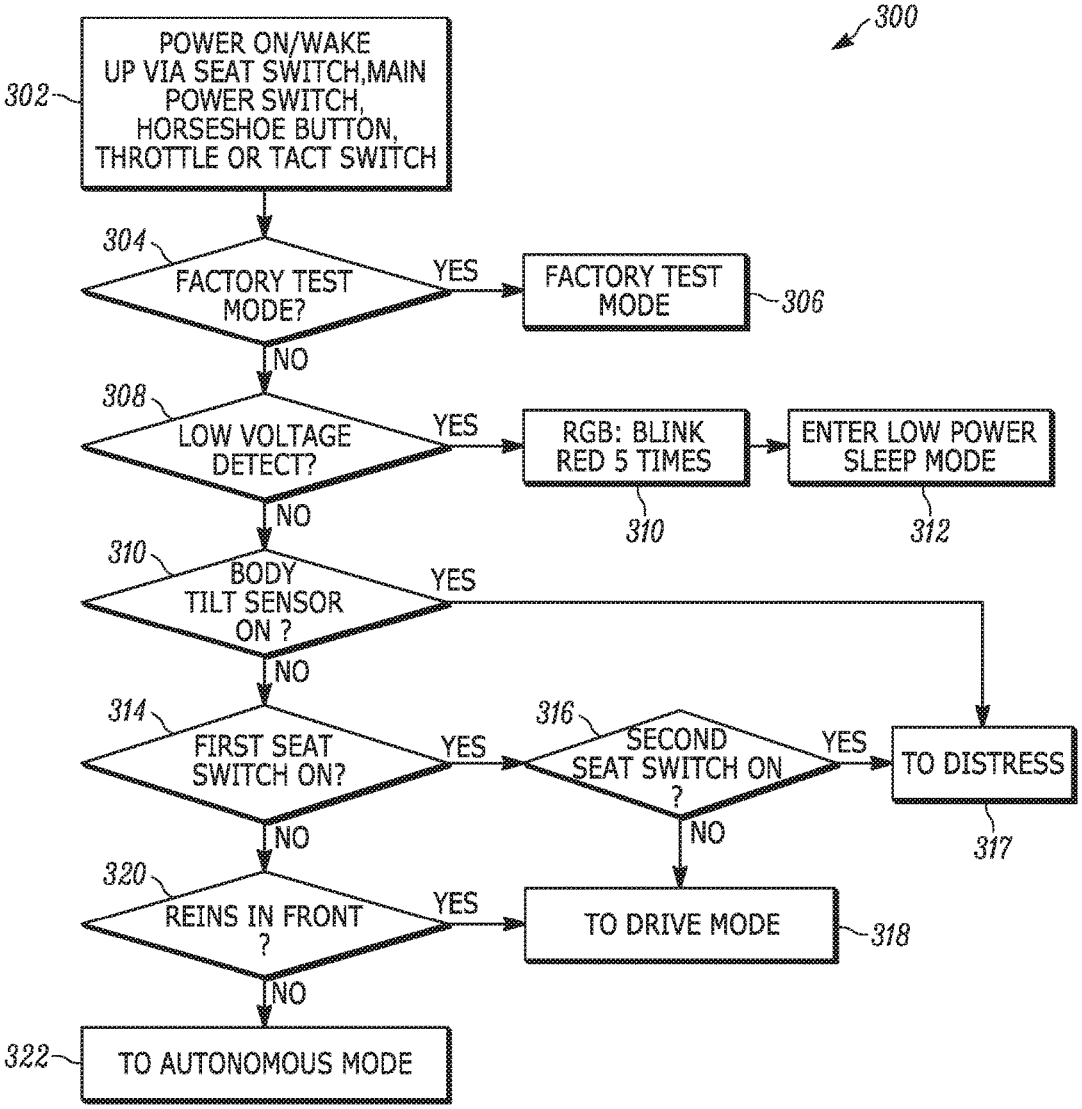
FIG. 20 is an exemplary flow chart describing the power on/wake sequence for the apparatus of FIG. 1.

Referring now to FIG. 20, a flow chart 300 is provided that illustrates various exemplary sequences that can occur when the apparatus 10 is activated by a user. To begin, at step 302, to initiate activation the main power switch 123 is switched on. If the main power switch 123 is already switched on and the apparatus 10 is in sleep mode, then activation can occur by various interactions, such as sitting on the seat 24 (activating the seat sensor), pushing the mode selection switch 114 (horseshoe button), pushing the throttle switch 110, triggering the mouth sensor (feeding) or mane switch (brushing the mane). Once activated the controller 130 checks if the apparatus 10 has been placed in factory test mode 306, if not then the controller 130 checks the voltage of the battery 26 at step 308 to determine if the battery voltage is sufficiently high. If a low voltage condition is detected at step 308, then at steps 310 and 312 the controller 130 activates the status light 115 to flash red several times, indicating to the user that the battery needs to be charged, and then sleep mode is activated to conserve power.

If at step 308, no low voltage condition is detected, the controller 130 checks if the body tilt sensor 116 is activated, indicating that the apparatus 10 is not upright and therefore is not safe for use, if yes, then distress mode is activated in step 312. If no, then the controller 130 checks if the first seat switch 270 is activated in step 314, indicating a user is sitting on the seat. If activated then in step 316 the controller 130 checks if the second seat switch 272 is activated indicating the apparatus 10 is overloaded, and if so, then distress mode is activated in step 317, if not, then drive mode is activated in step 318. If the first seat switch 270 is not activated, then in step 320 the controller 130 checks if the reins are in a forward or backward position. If the reins 90 are in the forward position (indicating that the user wishes to lead the apparatus 10 versus ride), then drive mode is activated in step 318. If the reins 90 are not sensed in the forward position in step 320, then autonomous mode is activated in step 322. As such, when the apparatus 10 is initially activated, the controller 130 will place it in one of various modes, such as autonomous, drive, distress, or sleep.

Figure 21:
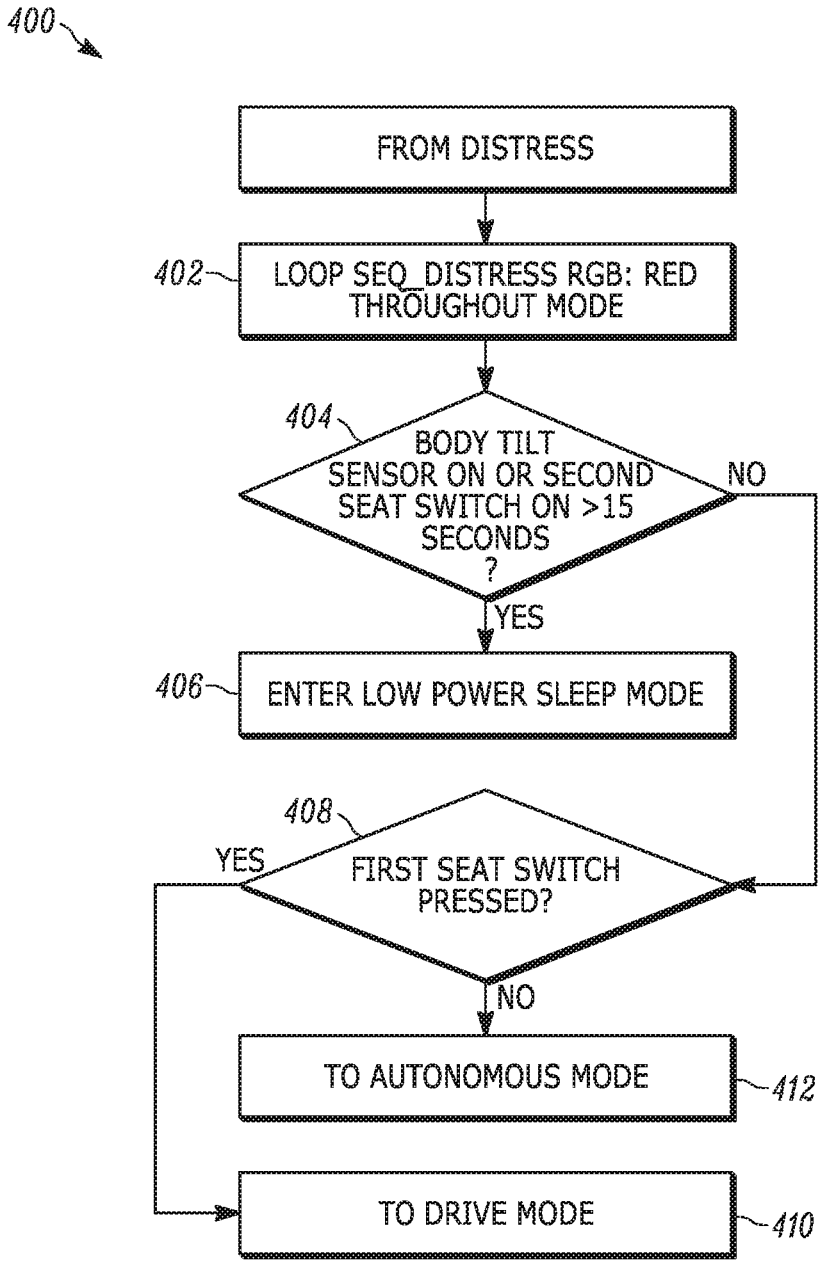
FIG. 21 is an exemplary flow chart describing distress mode sequences for the apparatus of FIG. 1.
Figure 22A:
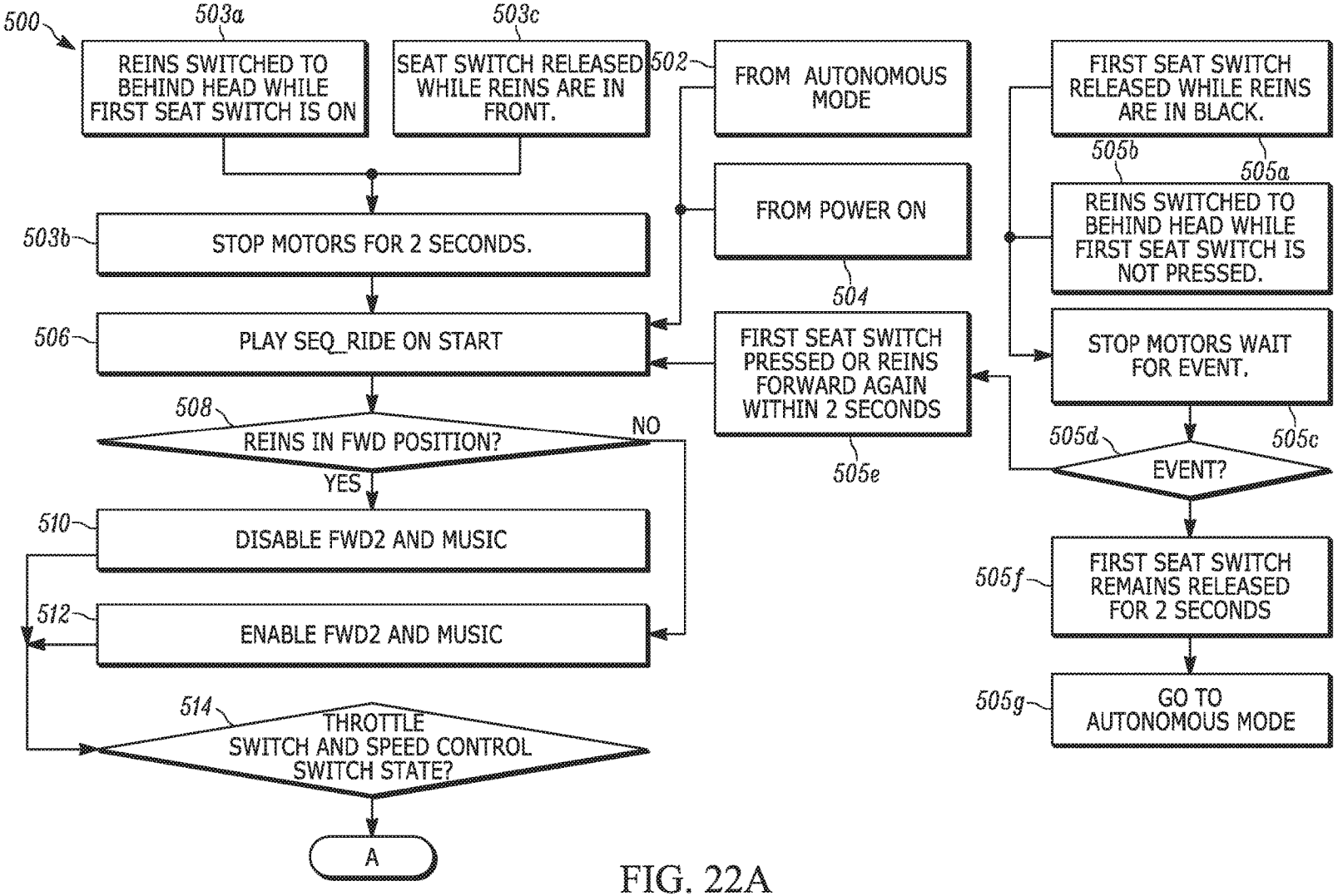
FIG. 22A-22D are an exemplary flow chart describing drive mode sequences for the apparatus of FIG. 1.
Figure 22B:
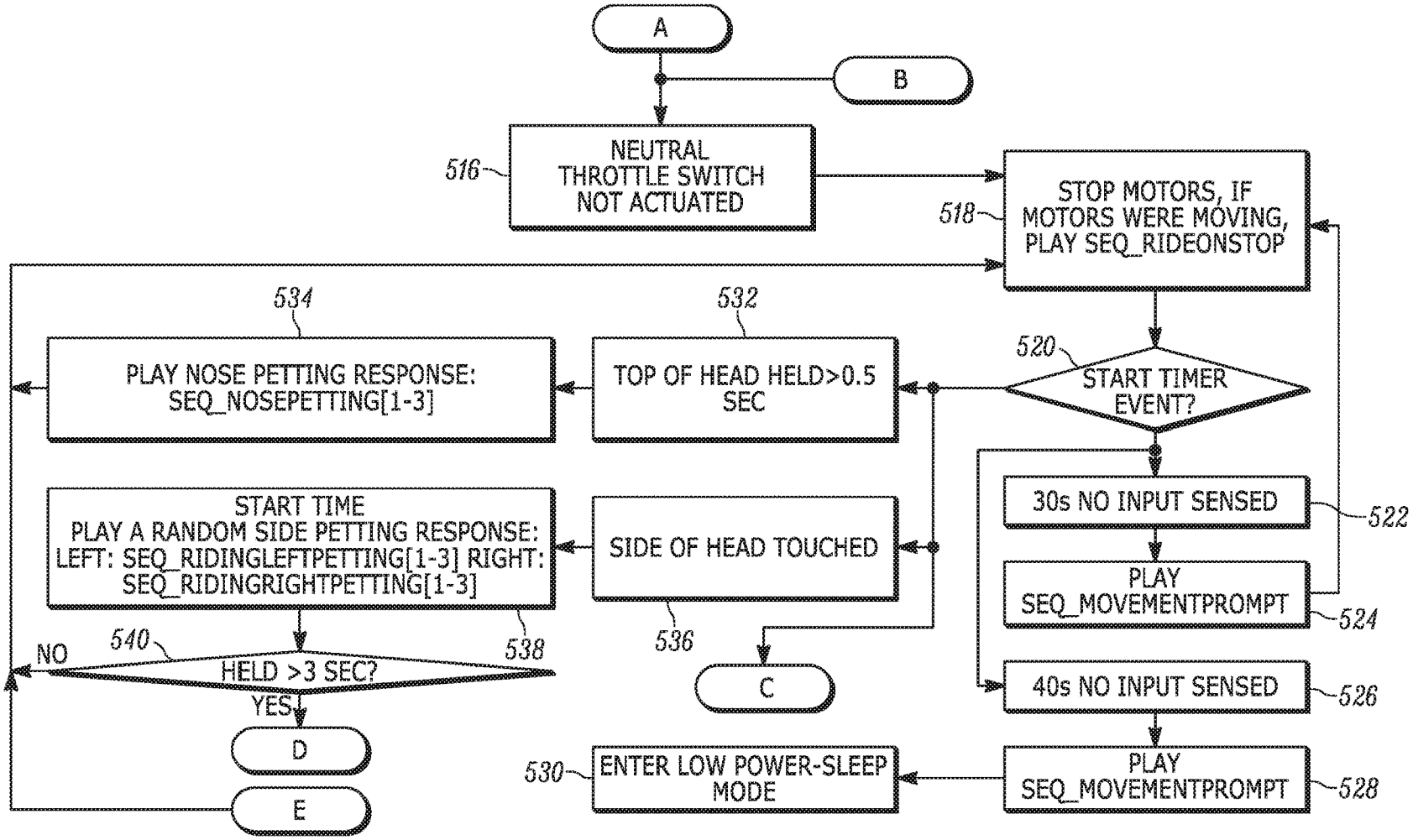
Figure 22C:
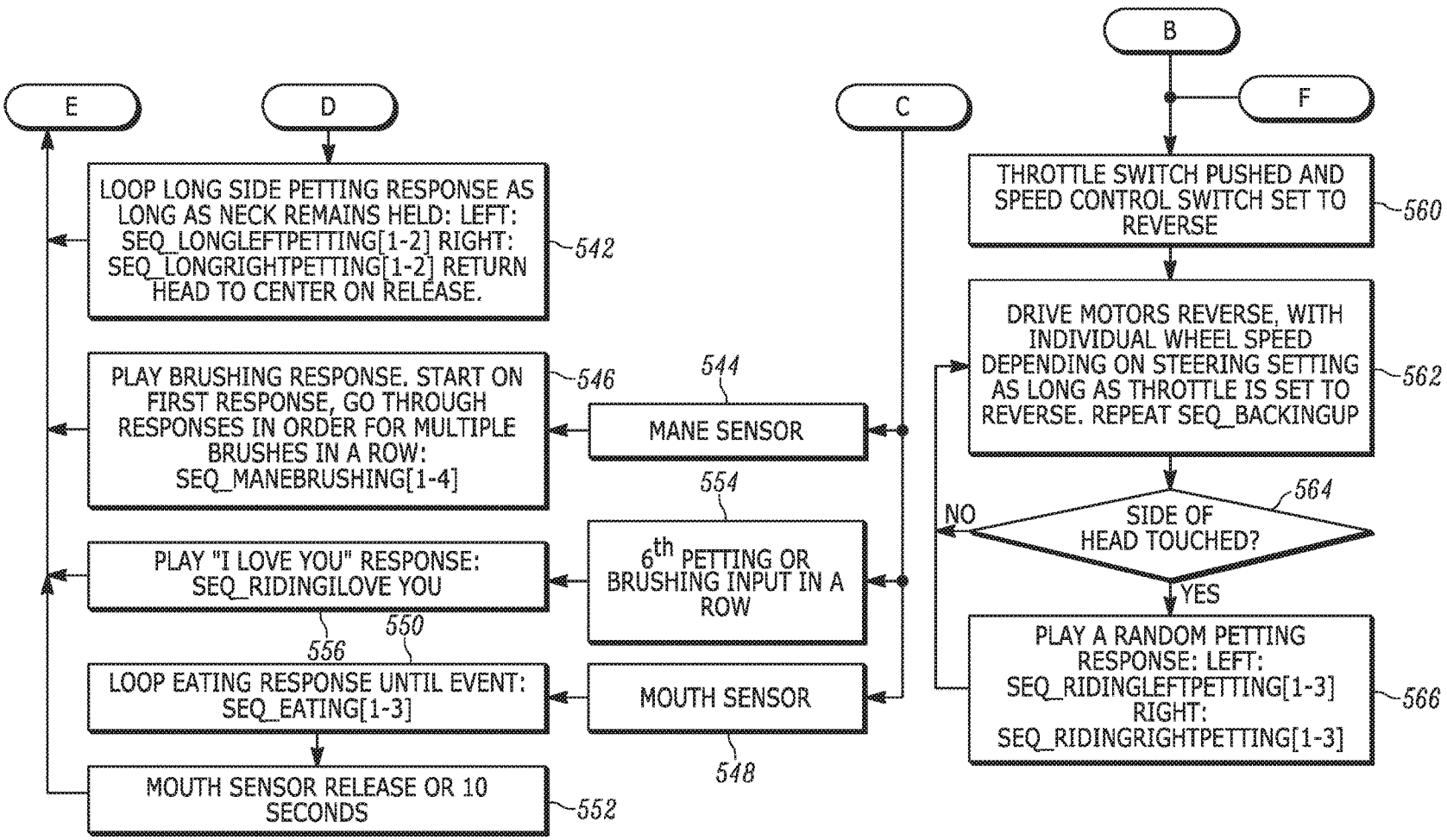
Figure 22D:
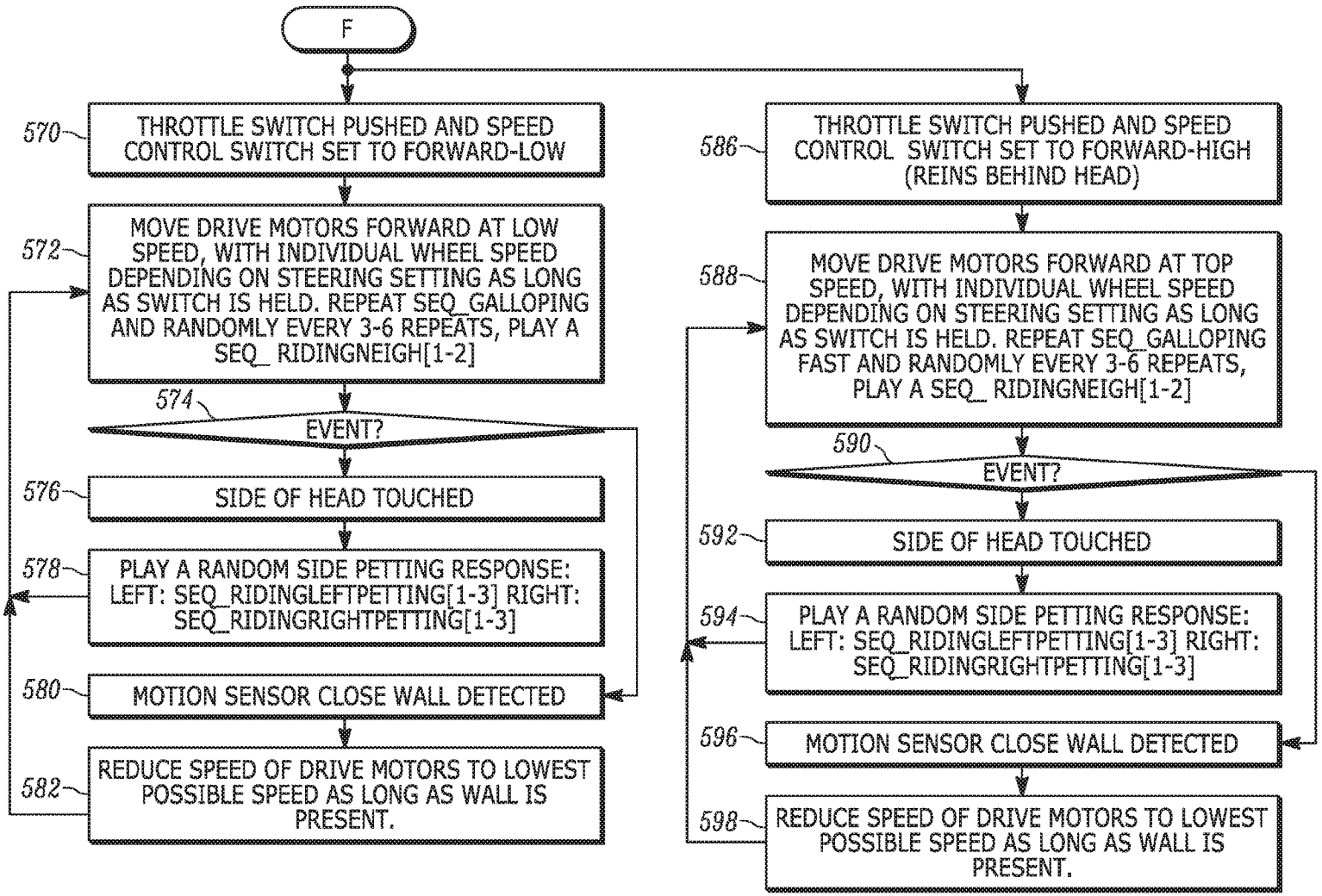
Figure 23A:
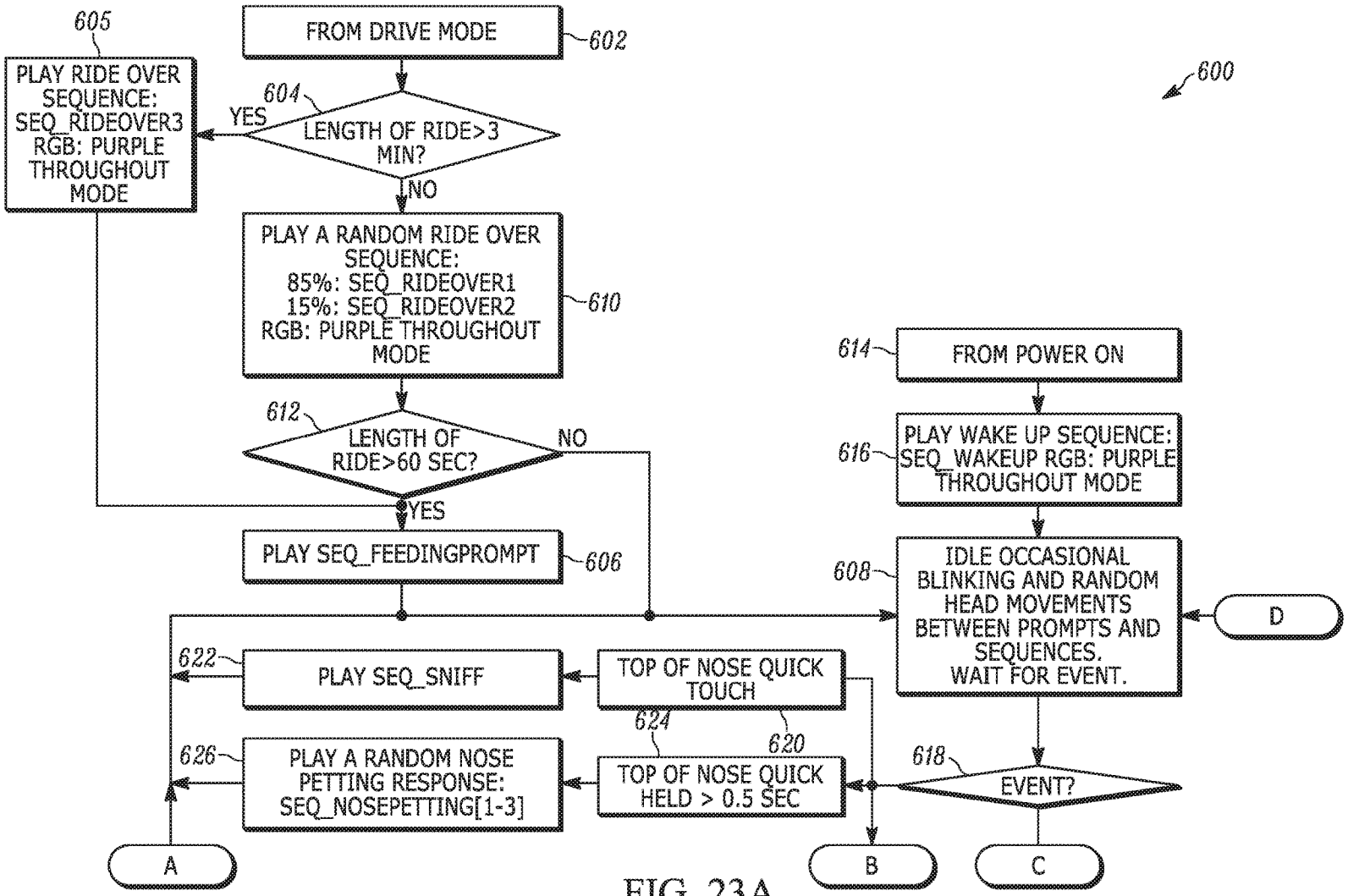
FIG. 23A-23D are an exemplary flow chart describing autonomous mode sequences for the apparatus of FIG. 1.
Figure 23B:
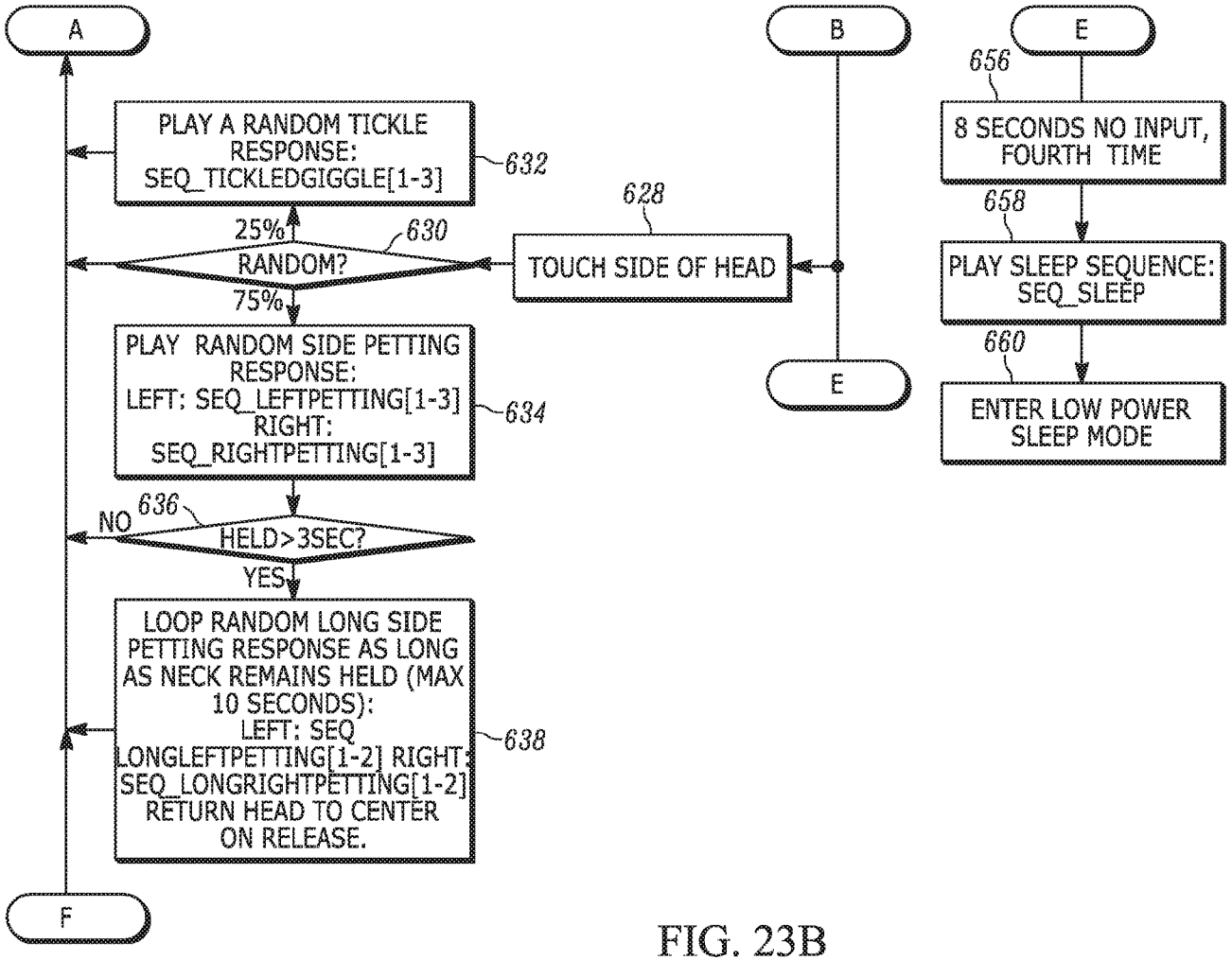
Figure 23C:
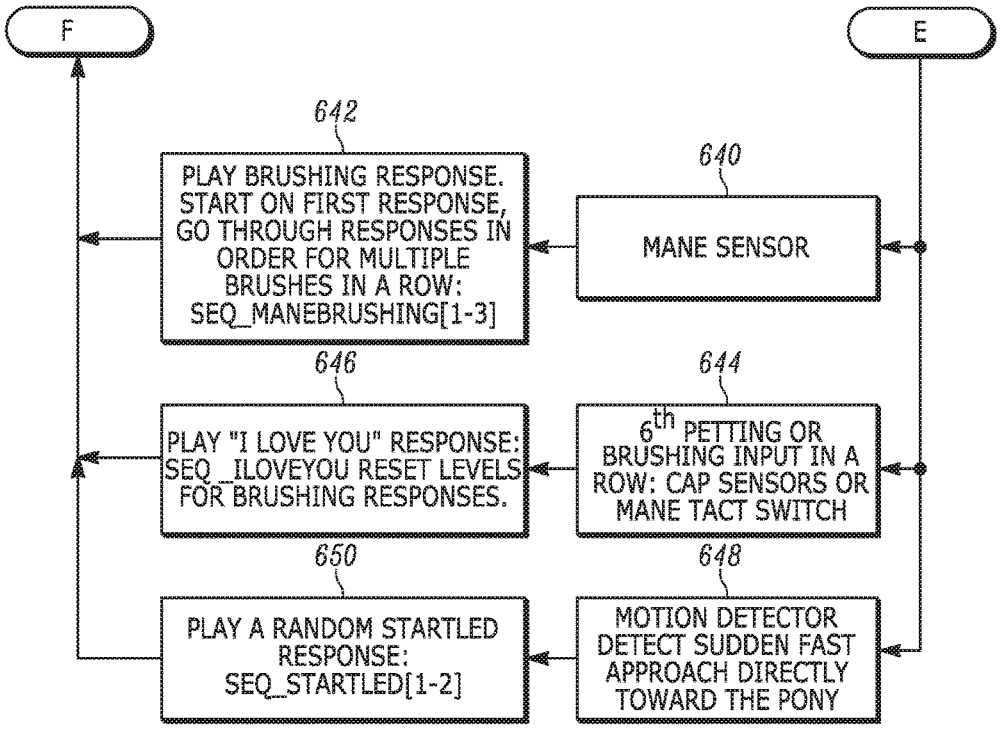
Figure 23D:
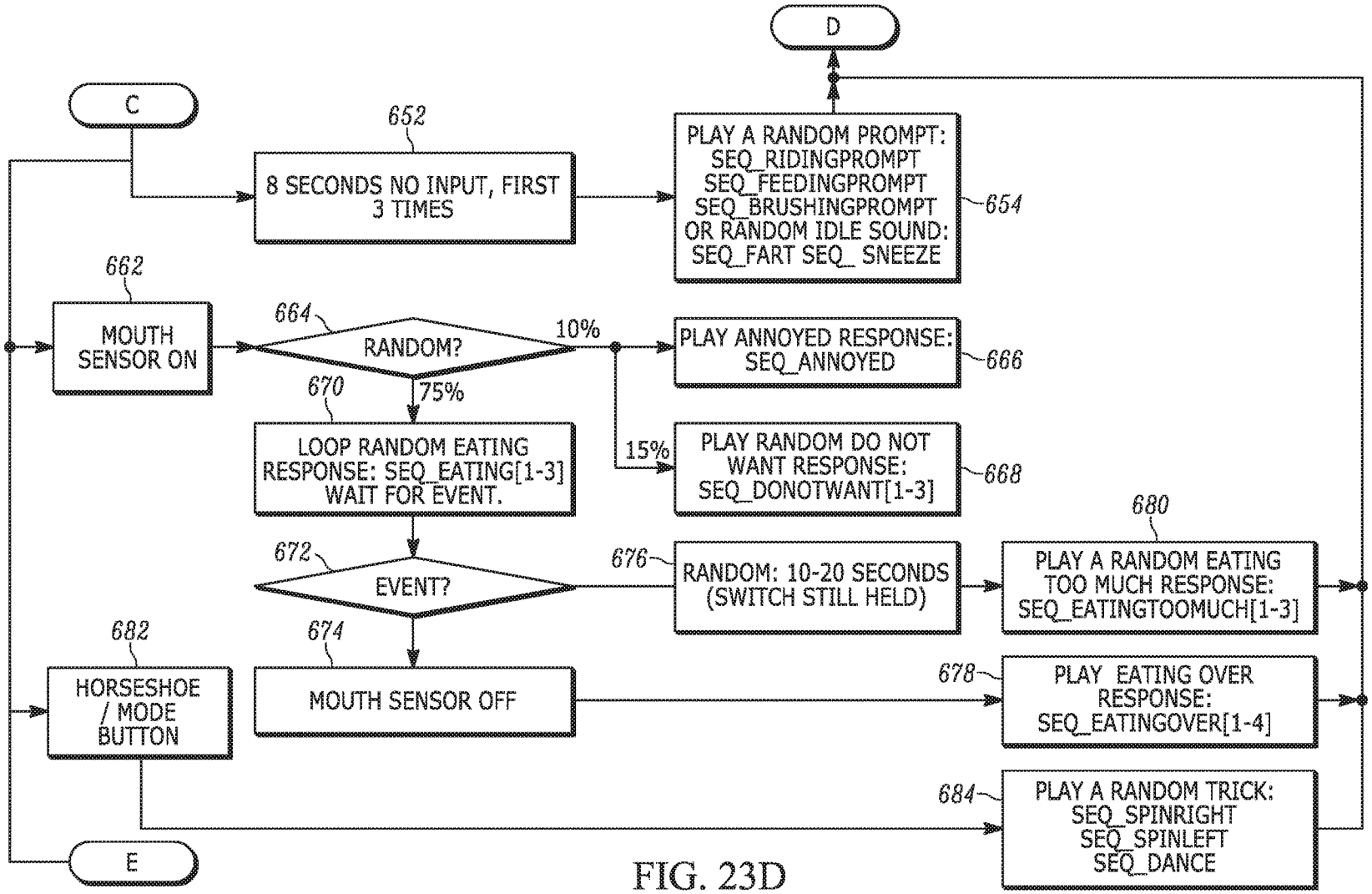

Referring to FIG. 21, a flow chart 400 is provided that illustrates an exemplary sequence that can occur when the apparatus 10 enters distress mode. Beginning at step 402, when distress mode is first entered the apparatus executes a distress sequence where the status light 115 illuminates red, the eyelids 70 blink repeatedly, and the speaker plays a distress sound to alert the user of a distress condition. At step 404 the controller 130 checks the body tilt sensor 116 and the second seat switch 272 and if either one remains on for greater than 15 seconds, then sleep mode is activated at step 406. If both are sensed as off, then at step 408 the controller 130 checks if the first seat switch 270 is on and if yes, then drive mode is activated at step 410, if no, then autonomous mode is activated at step 412. It is noted that for safety purposes, various sensors are continuously monitored when the apparatus is powered (i.e., the main power switch 123 is on). For example, if the body tilt sensor 116 or second seat switch 272 are sensed as on by the controller 130, all or some of the apparatus motors can be deactivated and distress mode activated. Similarly, if the controller 130 detects a battery low voltage condition, the status light 115 will flash red, indicating to the user that the battery needs to be charged, and sleep mode is activated.

Referring now to FIGS. 22A-22D, a flow chart 500 is provided that illustrates various sequences that can occur when the apparatus 10 has been placed in drive mode. Drive mode can be activated in several ways, such as through a power on/wake sequence (step 504) as discussed in flow chart 300, or by actuation of the mode selection switch 114 (step 502) when in autonomous mode. Whether drive mode is actuated through step 502 or 504, the sequence moves to step 506 which begins with the controller 130 executing SEQ_RideOnStart (see sequence tables for description), then in step 508, checks if the reins 90 are in the forward position and if yes, then in step 510 FWD2 is disabled along with the playing of music, if no, then in step 512 FWD2 and music are enabled.

Then at step 514, the controller 130 checks the throttle and speed control switch inputs. If the throttle switch 110 is sensed as not being actuated by the user, as noted in step 516 (FIG. 22B), then in step 518 any power to the drive wheel motors 46, 50 is ceased and, if the drive wheel motors 46, 50 were powered at the time of cessation, then the controller 130 executes SEQ_RideOnStop and advances to step 520 wherein the controller 130 starts a timer and waits for one of a plurality of events to occur. If none of the events described below occur within 30 seconds as noted in step 522, then in step 524 the controller 130 executes SEQ_MovementPrompt and returns to step 518. If none of the events occur within 40 seconds as noted in step 526, then in step 528 the controller 130 executes SEQ_MovementPrompt, and advances to step 530 to activate sleep mode. The various possible events that can be detected at step 520 include the detection of various inputs being activated by a user. More particularly, if the user touches the front head touch sensor 76 for more than 0.5 seconds at step 532 then at step 534 the controller 130 executes SEQ_NosePetting[1, 2, or 3] and returns to step 518. If the user touched either the left or right head touch sensor 78, 80 at step 536, then at step 538 the controller 130 executes a random petting response chosen from SEQ_RidingLeftPetting[1, 2, or 3] if the left head touch sensor 78 was sensed, and chosen from SEQ_RidingRightPetting[1, 2, or 3] if the right head touch sensor 80 was sensed. Then at step 540 if the activation of the left or right head touch sensor 78, 80 at step 536 ceased within three seconds, then the process returns to step 518, if the activation continued for greater than three seconds, then the process proceeds to step 542 where the controller 130 executes SEQ_LongLeftPetting[1 or 2] if the left head touch sensor 78 was sensed and SEQ_LongRightPetting[1 or 2] if the right head touch sensor 80 was sensed. Step 542 continues to run in a loop as long as the user remains in contact, when contact stops, the process returns to step 518. From step 520, if the user activates the mane sensor 84 (e.g., brushing the mane 67) as in step 544 (FIG. 22C), then instep 546 the controller 130 executes SEQ_ManeBrushing1 and continues through SEQ_ManeBrushing4 [1-4] incrementing one for each additional sensor activation (brush action) detected, then the process returns to step 518. From step 520, if the user activates the mouth sensor 82 (e.g., feeding action) as in step 548, then in step 550 the controller 130 executes SEQ_Eating[1-3] and continues in loop until either the mouth sensor is no longer sensed on or ten seconds has transpired in step 552, then the process returns to step 518. A final event can be triggered at step 554 if the controller 130 has sensed a sixth consecutive input from the mane sensor 84 or the head touch sensors 76, 78, 80, then at step 556 the controller 130 executes SEQ_RidingILoveYou and returns to step 518.

Referring back to step 514, if the speed control switch 112 is set to REV and the throttle switch 110 is actuated as in step 560, then at step 562 the controller 130 executes SEQ_BackingUp in a loop and commands one or both of the drive wheel motors 46, 50 to rotate in reverse. As noted above, specific activation of the drive wheel motors 46, 50 is dependent on the steering command, although if no steering command is present, both drive wheel motors 46, 50 will be activated simultaneously at the preselected reverse speed to propel the apparatus 10 in reverse. While operating in reverse the controller 130 monitors for other events such as activation of the left or right head touch sensors 78, 80 in step 564, if detected, then at step 566 the controller 130 executes a random petting response chosen from SEQ_RidingLeftPetting[1, 2, or 3] if the left head touch sensor 78 was sensed, and chosen from SEQ_RidingRightPetting[1, 2, or 3] if the right head touch sensor 80 was sensed, then returns to step 562.

Referring again back to step 514, if the speed control switch 112 is set to FWD1 (low speed) and the throttle switch 110 is actuated at step 570 (FIG. 22D), then at step 572 the controller 130 executes SEQ_Galloping and randomly every 3-6 repeats, executes SEQ_RidingNeigh[1 or 2], and the controller 130 also commands one or both of the drive wheel motors 46, 50 to propel the apparatus 10 at FWD1, depending on the steering position. Similar to reverse movement, while the throttle switch 110 is activated, the controller 130 monitors for other events at step 574, such as activation of the left or right head touch sensors 78, 80 at step 576, if detected, then at step 578 the controller 130 executes a random petting response chosen from SEQ_RidingLeftPetting[1, 2, or 3] if the left head touch sensor 78 was sensed, and chosen from SEQ_RidingRightPetting[1, 2, or 3] if the right head touch sensor 80 was sensed, and then returns to step 572. Another potential event that is monitored for is noted in step 580, wherein the motion sensor 136 detects an object in front of the apparatus 10, signaling a potentially imminent collision, wherein the process moves to step 582 wherein the power to the drive wheel motors 46, 50 is reduced or ceased until the object is no longer detected, the process then continues back at step 572.

Referring yet again back to step 514, if the speed control switch 112 is set to FWD2 (high speed) and the throttle switch 110 is actuated at step 586 (FIG. 22D), then at step 588 the controller 130 executes SEQ_GallopingFast and randomly every 3-6 repeats, executes SEQ_RidingNeigh[1 or 2], and the controller 130 also commands one or both of the drive wheel motors 46, 50 to propel the apparatus 10 at FWD2, depending on the steering position. Similar to reverse movement, while the throttle switch 110 is activated, the controller 130 monitors for other events at step 590, such as activation of the left or right head touch sensors 78, 80 at step 592, if detected, then at step 594 the controller 130 executes a random petting response chosen from SEQ_RidingLeftPetting[1, 2, or 3] if the left head touch sensor 78 was sensed, and chosen from SEQ_RidingRightPetting[1, 2, or 3] if the right head touch sensor 80 was sensed, and then returns to step 588. Another potential event that is monitored for is noted in step 596, wherein the motion sensor 136 detects an object in front of the apparatus 10, signaling a potentially imminent collision, wherein the process moves to step 598 wherein the power to the drive wheel motors 46, 50 is reduced or ceased until the object is no longer detected, the process then continues back at step 588. In at least some embodiments, the detected object includes a person, such as the user (e.g., child interacting with the toy), moving in front of the apparatus 10, while in other embodiments the detected object can include a person and/or a structure, such as a wall.

Referring again to FIG. 22A, other actions can occur based on sensed inputs that will lead to step 506. For example, at step 503*a*, if the reins back sensor 96 signals to the controller 130 that the reins 90 have been moved to the backward position (in front of the rider), while the first seat switch 270 is on, then at step 503*b* the drive wheel motors will stop for 2 seconds and then proceed to step 506. In addition, at step 503*c*, if the first seat switch 270 is changed to off while the reins 90 are sensed in the forward position then the drive wheel motors will stop for 2 seconds and then proceed to step 506. Further, if the first seat switch 270 is changed to off while the reins 90 are sensed in the backward position in step 505*a*, or if the reins 90 are moved to the backward position, while the first seat switch 270 is off, as in step 505*b*, then at step 505*c* the drive wheel motors will stop and wait for an event at step 505*d*. The event at step 505*d* can include steps 505*e* or step 505*f*. In step 505*e*, if the first seat switch 270 is sensed on or the reins 90 are moved to the forward position again within two seconds, the process moves to step 506. In step 505*f*, if the first seat switch 270 remains off for two seconds then the controller 130 activates autonomous mode at step 505*g*.

Referring now to FIGS. 23A-23D, a flow chart 600 is provided that details further exemplary actions can be taken from power on and drive mode that lead to autonomous mode actions, which can include actions taken without persistent user interaction. In at least some embodiments, when operated in autonomous mode, the controller 130 directs actuation of the drive wheel motor assemblies 38, 42 and neck assembly 54 according to a predetermined sequence, and in drive mode, the controller 130 only directs actuation of the drive wheel motor assemblies 38, 42 based on actuation of the throttle switch 110.

Beginning at step 602 while in drive mode, if the user is operating the throttle switch 110 to propel the apparatus 10 and the length of the ride exceeds three minutes at step 604, then at step 605 the controller 130 will execute SEQ_RideOver3, then proceed to step 606 and execute SEQ_FeedingPrompt (which prompts the user to feed the toy), followed by step 608 where the apparatus 10 is put in idle mode, which includes random eyelid blinking and head movements. Returning to step 604, if the length of the ride does not exceed three minutes, then at step 610 the controller randomly chooses to execute one of SEQ_RideOver1 and SEQ_RideOver2, and if the length of the ride exceeds sixty seconds at step 612, then the process proceeds to step 606, otherwise the process moves to step 608.

Idle mode at step 608 can also be activated after a power on at step 614 and wake up sequence has been executed at step 616. While the apparatus 10 is in idle mode at step 608 it is monitoring for numerous possible events to occur as noted at step 618. Sensing of a particular event causes the controller 130 to execute (i.e., play) a specific response as detailed in the flow chart 600 and the sequence tables (FIGS. 24A-25D) followed by a return to idle mode at step 608. Various exemplary events can include the following: i) user touching (e.g., petting, stroking, etc.) the front of the head (nose) for a brief moment (steps 620 and 622); ii) user continuously touching the front of the head for more than 0.5 seconds (steps 624 and 626); user touching the left or right side of the head (steps 628, 630, 632, and 634), wherein the touch executes a random action, which can then be extended to include additional actions if the user holds their contact on the head (e.g., hugging) (steps 636 and 638); iii) user brushing the mane (steps 640 and 642); iv) user consecutively touching or brushing six times (steps 644 and 646); v) user approaching the apparatus quickly, as sensed by the motion detector (steps 648 and 650); vi) eight seconds transpires with no inputs sensed (steps 652 and 654 for the first three occurrences, then steps 656, 658, and 660); vii) user inserts object in the mouth (feeding) (step 662) which can generate a random dislike response (steps 666 or 668), or an eating response (steps 670), which then monitors the time the mouth sensor is on (steps 674 and 676) and can either provide a finished eating response (step 678) or provide a full expression (step 680); and finally viii) user pushes the mode selection switch (horseshoe button) 114 (step 682), which initiates execution of a random trick (step 684).

As noted in the sequence tables, the apparatus 10 can perform a plurality of dance sequences (i.e., SEQ_Dance and SEQ_Dance2) which would include a preprogrammed sequence of discrete motor commands being progressively sent by the controller 130 to actuate the drive wheel motors 46, 50 in forward and/or reverse directions, causing the apparatus 10 to be propelled along the floor in time with a song played over the speaker 140. Additional commands can be provided to actuate the head, ears, eyelids, illuminate the status light 115, etc.

In at least some embodiments, the input from the motion sensor 136 can be used to trigger new or continued motor commands by the controller 130. In this manner, the controller 130 could require confirmation of sensed motion by a user before continuing with a subsequent power output command to the drive wheel motors 46, 50 that would change the direction or power level applied to the drive wheel motors 46, 50. This feature can be utilized in the dance sequence, as well as when a user is interacting with the apparatus 10, such as brushing the mane, feeding the mouth, or touching the head. Although this feature may be utilized with the drive wheel motors 46, 50, other body movement motors, such as the feature motor, the head rotation motors, etc., may be actuated in any of numerous sequences with or without movement of the drive wheel motors 46, 50 and/or sensed motion inputs from the motion sensor 136.

It is specifically intended that the apparatus is not to be limited to the embodiments and illustrations contained herein, but include modified forms of those embodiments including portions of the embodiments and combinations of elements of different embodiments as come within the scope of the following claims. Further the various motors described herein can be coupled to additional components in any of numerous mechanisms, such as gears, actuators, levers, pulleys, etc. to perform the described functions. Further modifications and alternative embodiments of various aspects of the apparatus will be apparent to those skilled in the art in view of this description. Accordingly, this description is to be construed as illustrative only and is for the purpose of teaching those skilled in the art the general manner of carrying out the invention. It is to be understood that the forms of the apparatus shown and described herein are to be taken as the presently preferred embodiments. Elements and materials may be substituted for those illustrated and described herein, parts and processes may be reversed, and certain features of the apparatus may be utilized independently, all as would be apparent to one skilled in the art after having the benefit of this description of the apparatus. Changes may be made in the elements described herein without departing from the spirit and scope of the apparatus as described in the following claims. In addition, any steps described herein with reference to the flow charts are not to be considered limiting and can include variations, such as additional steps, removed steps, and re-ordered steps.

What is claimed is:

1. An interactive ride-on toy apparatus comprising:

a torso;

a plurality of legs secured to the torso;

a first drive motor assembly secured to a first of the plurality of legs and to a first drive wheel;

a second drive motor assembly secured to a second of the plurality of legs and to a second drive wheel;

a motorized neck assembly coupling a head to the torso, wherein the neck assembly provides a multi-directional rotational movement of the head relative to the torso;

a rechargeable battery;

a throttle switch to provide a throttle signal;

a controller including one or more processors and one or more memory devices; and an electrical steering position sensor configured to translate a mechanical steering input via manual rotation of the head into an electronic steering position signal that is communicated to the controller, wherein the controller is configured to receive the throttle signal and the steering position signal, and selectively actuate at least one of the drive wheel motors based on the throttle signal and the steering position signal.

2. The apparatus of claim 1, wherein the rotational movement of the head relative to the torso includes selective rotational movement of the head about a first axis or a second axis that is perpendicular to the first axis.

3. The apparatus of claim 2, wherein movement of the head about the first axis and second axis can be performed simultaneously.

4. The apparatus of claim 3, further comprising a plurality of touch-based sensors situated in the head.

5. The apparatus of claim 4, wherein at least one or more touch-based sensors situated in the head include a capacitive-based sensors.

6. The apparatus of claim 4, wherein the controller proportionally varies applied power from the battery to each of the first drive motor assembly and the second drive motor assembly based on the steering position signal.

7. The apparatus of claim 6, further comprising a speaker for emitting sounds selected by the controller, a seat positioned on the torso, and a first seat switch situated between the seat and the torso, wherein actuation of the first seat switch by a user provides a rider detected input signal.

8. The apparatus of claim 7, further comprising a motion sensor coupled to the controller and configured to detect the presence of an object situated in front of the torso.

9. The apparatus of claim 8, further comprising reins pivotably coupled to the head, wherein the reins include the throttle switch and a speed and direction selection switch.

10. The apparatus of claim 9, wherein the reins are coupled to the head via a reins pivot assembly that allows the reins to be rotated between a forward position and a back position relative to the head, and wherein the reins pivot assembly further includes at least one of a reins forward sensor and a reins back sensor to indicate to the controller the position of the reins.

11. The apparatus of claim 10, wherein a third and a fourth of the plurality of legs each include a freely pivotable non-motorized wheel.

12. The apparatus of claim 11, wherein the torso further includes a first torso portion pivotably coupled to a second torso portion along a vertical pivot joint.

13. The apparatus of claim 12, wherein the head further includes a mouth, ears, and eyelids, and wherein the eyelids and the ears are rotatably actuatable via a signal from the controller.

14. The apparatus of claim 13, wherein the touch-based sensors include a right head touch sensor, a left head touch sensor, and a front head touch sensor.

15. The apparatus of claim 14, further comprising a mode selection switch for selecting between a first mode and a second mode, wherein the first mode directs the controller to actuate the drive wheel motor assemblies and neck assembly according to a predetermined sequence, and the second mode directs the controller to actuate the drive wheel motor assemblies only upon actuation of the throttle switch.

16. An interactive ride-on toy apparatus comprising:

a torso having a first torso portion and a second torso portion;

a first front leg and a second front leg, each extending down from the first torso portion;

a first drive motor coupled to the first front leg and to a first drive wheel;

a second drive motor coupled to the second front leg and to a second drive wheel, wherein the first and second drive wheels are rotatable propel the apparatus along a surface;

a non-motorized wheel coupled to the second torso portion;

a motorized neck assembly coupling a head to the first torso portion, wherein the neck assembly provides selective rotational movement of the head along both a first rotational head axis and a second rotational head axis;

a rechargeable battery;

a throttle switch to provide a throttle input signal;

a controller for receiving the throttle input signal and selectively actuating the drive motor assemblies with power from the battery;

an electrical steering position sensor for receiving a mechanical steering input upon manual rotation of the head, wherein the controller proportionally varies the applied power from the battery to the first drive motor assembly and the second drive motor assembly based on a steering position signal provided by the steering position sensor;

a plurality of touch-based sensors situated in the head for providing a touch input signal;

reins coupled to the head, wherein the reins include the throttle switch and a speed and direction selection switch;

a speaker for emitting sounds selected by the controller; and a seat positioned on the torso.

17. The apparatus of claim 16, further comprising a first seat switch situated between the seat and the torso, wherein actuation of the first seat switch by a user provides a rider detected input signal.

18. The apparatus of claim 17, further comprising a motion sensor configured to detect the presence of an object situated in front of the first torso portion.

19. The apparatus of claim 18, wherein the first rotational head axis is situated perpendicular to the second rotational head axis, and wherein the reins are coupled to the head via a reins pivot assembly that allows the reins to be rotated between a forward position and a back position relative to the head, and wherein the reins pivot assembly provides a reins position input signal to the controller indicating the sensed position of the reins.

20. An interactive ride-on toy apparatus comprising:

a torso having a first torso portion pivotably coupled to a second torso portion along a vertical pivot joint;

a first front leg and a second front leg, each extending down from the first torso portion;

a first drive motor assembly secured to the first front leg and to a first drive wheel;

a second drive motor assembly secured to the second front leg and to a second drive wheel, wherein the first and second drive wheels are rotatable about a single rotational drive axis to propel the apparatus along a surface;

a first rear leg and a second rear leg, each extending down from the second torso portion and including a wheel secured thereto;

a motorized neck assembly coupling a head to the first torso portion, wherein the neck assembly provides selective rotational movement of the head along both a first rotational head axis and a second rotational head axis, wherein the second rotational head axis lies parallel to the rotational drive axis and perpendicular to the first rotational head axis;

a rechargeable battery situated in at least one of the torso and the head;

a throttle switch to provide a throttle input;

a controller for receiving the throttle input and selectively actuating the drive motor assemblies using the rechargeable battery;

an electrical steering position sensor for receiving a mechanical steering input via manual rotation of the head, and wherein the controller proportionally varies the applied power from the battery to the first drive motor assembly and the second drive motor assembly based on a received steering position sensor input;

a plurality of touch-based sensors situated in the head for receiving touch signals from a user;

wherein the head includes a mouth, eyelids, and ears, and wherein the eyelids and the ears are rotatably actuatable via a signal from the controller;

reins pivotably coupled to the head, wherein the reins include the throttle switch and a speed and direction selection switch, and wherein the reins are coupled to the head via a reins pivot assembly that allows the reins to be rotated between a forward position and a back position relative to the head, and wherein the reins pivot assembly provides a reins position input signal to the controller indicating the position;

a speaker for emitting sounds selected by the controller;

a seat positioned on the torso;

a first seat switch situated between the seat and the torso, wherein actuation of the first seat switch by a user provides a rider detected input signal;

a motion sensor configured to detect the presence of another object situated in front of the first torso portion; and a mode selection switch for selecting between a first mode and a second mode, wherein the first mode directs the controller to actuate the drive wheel motor assemblies and neck assembly according to a predetermined sequence, and the second mode directs the controller to actuate the drive wheel motor assemblies only during actuation of the throttle switch.

* * * * *